US008400137B2

(12) United States Patent
Nagumo

(10) Patent No.: US 8,400,137 B2
(45) Date of Patent: Mar. 19, 2013

(54) REFERENCE VOLTAGE GENERATION CIRCUIT, DRIVE CIRCUIT, LIGHT EMITTING DIODE HEAD, AND IMAGE FORMING APPARATUS

(75) Inventor: Akira Nagumo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 744 days.

(21) Appl. No.: 12/216,741

(22) Filed: Jul. 10, 2008

(65) Prior Publication Data

US 2009/0051343 A1 Feb. 26, 2009

(30) Foreign Application Priority Data

Aug. 21, 2007 (JP) ..... 2007-214832

(51) Int. Cl.
*G05F 3/16* (2006.01)
*G05F 3/20* (2006.01)

(52) U.S. Cl. ..... 323/315

(58) Field of Classification Search ..... 323/315, 323/316; 327/512, 542
See application file for complete search history.

(56) References Cited

U.S. PATENT DOCUMENTS

| | | | | |
|---|---|---|---|---|
| 5,334,929 | A * | 8/1994 | Schade, Jr. | 323/315 |
| 5,942,888 | A * | 8/1999 | Tan | 323/315 |
| 6,028,472 | A * | 2/2000 | Nagumo | 327/512 |
| 6,677,808 | B1 * | 1/2004 | Sean et al. | 323/313 |
| 6,900,689 | B2 * | 5/2005 | Kimura | 323/316 |

FOREIGN PATENT DOCUMENTS

JP 10-332494 12/1998

* cited by examiner

*Primary Examiner* — Jue Zhang
(74) *Attorney, Agent, or Firm* — Kubotera & Associates, LLC

(57) ABSTRACT

A reference voltage generation circuit includes a current-mirror circuit formed of a plurality of MOS (Metal Oxide Semiconductor) transistors each having a source terminal connected to a power source and a gate terminal connected to with each other; and a plurality of transistors each connected to a drain terminal of each of the MOS transistors of the current-mirror circuit for controlling the current-mirror circuit, so that an output current of the current-mirror circuit is converted to a voltage to be output as a reference voltage. Each of the MOS transistors of the current-mirror circuit has the drain terminal connected to a collector terminal of each of the transistors. Accordingly, when a voltage of the power source varies, it is possible to maintain a collector voltage of each of the transistors at a specific level and a collector current of each of the transistors constant.

24 Claims, 27 Drawing Sheets

REFERENCE VOLTAGE GENERATION CIRCUIT, DRIVE CIRCUIT, LIGHT EMITTING DIODE HEAD, AND IMAGE FORMING APPARATUS

BACKGROUND OF THE INVENTION AND RELATED ART STATEMENT

The present invention relates to a reference voltage generation circuit for driving a group of driven elements such as, for example, an array of light emitting diodes (LEDs) disposed in an electro-photography printer as a light source, an array of heating resistors disposed in a thermal printer, and an array of display units disposed in a display device. The present invention also relates to a drive circuit including the reference voltage generation circuit; a light emitting diode (LED) head including the drive circuit; and an image forming apparatus including the light emitting diode (LED) head.

In the specification, a light emitting diode may be referred to as an LED; a monolithic integrated circuit may be referred to as an IC (Integrated Circuit); an n-channel MOS (Metal Oxide Semiconductor) transistor may be referred to as an NMOS; and a p-channel MOS transistor may be referred to as a PMOS.

Further, a signal terminal and a signal input to or output from the signal terminal may be designated with a same reference designation. A static latent image formed on a photosensitive drum according to each of light emitting elements, or a toner image after development or transferred to a printing medium may be referred to as a dot. Each of the light emitting elements corresponding to the dot also may be referred to as a dot.

An LED head is a generic nomenclature of a unit in which a light emitting element and a drive element thereof are disposed. When the LED head is disposed only in a printer device, the LED head is referred to as an LED print head. In the following description, a group of driven elements is an array of LEDs used in an electro-photography printer as an example.

In a conventional image forming apparatus such as an electro-photography printer, a photosensitive drum charged is selectively irradiated according to print information, thereby forming a static latent image thereon. Then, toner is attached to the static latent image to form a toner image. Afterward, the toner image is transferred to a sheet, so that the toner image is developed. An LED is used as a light source. An LED head used in the conventional printer is formed of an LED array chip having a plurality of LED elements and a driver IC for driving the LED array chip.

The LED head includes a reference voltage generation circuit for generating a reference voltage, so that a drive current for driving the LED elements is determined based on the reference voltage generated from the reference voltage generation circuit and a resistor disposed in the driver IC. The resistor is produced through a semiconductor process technology. In general, the resistor is formed of poly-silicon or an impurity diffused resistor, and is integrated in the driver IC in a form of monolithic.

Patent Reference has disclosed such a conventional electro-photography printer. In the conventional electro-photography printer, the LED elements have light emission power having temperature dependence with a negative temperature coefficient. Accordingly, when a junction temperature of the LED array chip increases, the light emission power decreases. For example, when the LED is formed of an AlGaAs element, the temperature coefficient is −0.25%/° C. When a temperature increases upon the LED light emission, the light emission power decreases significantly. Patent Reference: Japanese Patent Publication No. 10-332494

As described above, the driver IC of the LED elements is disposed in the LED head. Accordingly, it is preferable that the temperature coefficient of the LED drive current value becomes positive, thereby compensating the negative temperature coefficient of the LED light emission power. The LED drive current value is determined based on the resistor disposed in the IC driver and the value of the voltage output from the reference voltage generation circuit. Accordingly, considering a temperature coefficient of the resistor (generally positive value), it is necessary to provide the voltage output from the reference voltage generation circuit with a positive temperature coefficient.

As described above, even when the temperature varies upon the LED drive, it is necessary to maintain the light emission power at a specific level. To this end, it is necessary to provide a drive method for compensating the temperature dependence of the light emission power of the LED elements. Patent Reference has disclosed a circuit having such a temperature compensation circuit as explained below.

FIG. 22 is a circuit diagram showing a drive circuit of the LED head of the conventional printer. FIG. 23 is a circuit diagram showing a conventional reference voltage generation circuit 37 disclosed in Patent Reference. More specifically, FIG. 22 is a circuit diagram showing a main portion of the driver IC. FIG. 22 shows a connection relationship between the LED drive circuit and a peripheral circuit thereof, and one LED element (one dot) is shown in FIG. 22.

As shown in FIG. 22, the LED drive circuit includes a pre-buffer circuit G1 indicated with a hidden line, and the pre-buffer circuit G1 is formed of an AND circuit 42, a PMOS transistor 43, and an NMOS transistor 44. Further, the LED drive circuit includes an inverter circuit G0, a latch circuit LT1, and a control voltage generation circuit 36 indicated with a projected line. The control voltage generation circuit 36 is disposed per one driver IC chip.

A operational amplifier 51 outputs a voltage Vcont (control potential) to an LED drive transistor Tr1 for adjusting a drive current of an LED element LD1. Further, the LED drive circuit includes a resistor 53 having a resistivity of Rref, and a PMOS transistor 52 having a gate length the same as that of the LED drive transistor Tr1.

A reference voltage input terminal VREF is connected to an reverse input terminal of the operational amplifier 51, so that a reference voltage Vref generated at the reference voltage generation circuit (described later) is input. The operational amplifier 51, the PMOS transistor 52, and the resistor 53 constitute a feedback control circuit. A current Iref flowing through the resistor 53, that is, the PMOS transistor 52, is not depended on a power source voltage VDD, and is determined only by the reference voltage Vref and the resistivity Rref of the resistor 53.

The operational amplifier 51 controls such that a potential of the reverse input terminal thereof becomes equal to a potential of a non-reverse input terminal thereof. Accordingly, the current Iref flowing through the resistor 53 is given by:

$$Iref=Vref/Rref$$

As described above, it is configured such that the PMOS transistor 52 has the gate length the same as that of the LED drive transistor Tr1. A gate potential thereof becomes equal to the voltage Vcont upon driving the LED element. Accordingly, the PMOS transistor 52 and the LED drive transistor Tr1 operate in a saturated region, and have a current-mirror relationship.

As a result, a drive current value of the LED element LD1 is proportional to the current Iref flowing through the resistor 53, and the current Iref is proportional to the reference voltage Vref input into the VREF terminal. Accordingly, it is possible to collectively adjust the LED drive current according to the reference voltage Vref.

FIG. 23 is a circuit diagram showing the conventional reference voltage generation circuit 37 for generating the reference voltage Vref.

As shown in FIG. 23, PMOS transistor M1, M2, and M3 with a same size have source terminals connected to the power source VDD and gate terminals connected to each other, thereby constituting a current-mirror circuit. A drain terminal of the PMOS transistor M1 is connected to a collector terminal of an NPN bipolar transistor Q1 through resistor 60 and 61 connected in series. The NPN bipolar transistor Q1 has an emitter terminal connected to ground and a base terminal connected to a connection point of the resistors 60 and 61.

A drain terminal of the PMOS transistor M2 of the current-mirror circuit is connected to a collector terminal of an NPN bipolar transistor Q2. The NPN bipolar transistor Q2 has an emitter terminal connected to ground and a base terminal connected to the collector terminal of the NPN bipolar transistor Q1. A drain terminal of the PMOS transistor M3 is connected to ground through a resistor 62.

The NPN bipolar transistor Q2 has an emitter area N times larger than an emitter area of the NPN bipolar transistor Q1 (N>1). A connection point of the drain terminal of the PMOS transistor M3 and the resistor 62 becomes an output terminal of the conventional reference voltage generation circuit 37 for outputting the reference voltage Vref.

As disclosed in Patent Reference, the conventional reference voltage generation circuit 37 shown in FIG. 23 generates an output voltage having a positive temperature coefficient. As shown in FIG. 23, the resistors 60, 61, and 62 have resistivities of R0, R1, and R2, respectively.

In the conventional reference voltage generation circuit 37 shown in FIG. 23, it is assumed as follows:

A base current is negligibly small relative to a collector current of the bipolar transistor. In other words, a current amplification ratio of the transistor is smaller than one. The collector current of the bipolar transistor is independent of a voltage between the collector terminal and the emitter terminal thereof. In other words, an early voltage of the bipolar transistor has a sufficiently large property.

Base on the assumptions described above, the output voltage Vref of the conventional reference voltage generation circuit 37 is given by:

$$V\text{ref}=(R2/R1)\times(kT/q)\ln(N)$$

Where k is the Boltzmann constant, T is an absolute temperature, q is a charge of electron, and ln represents natural legalism.

It is supposed that a temperature coefficient Tc of the output voltage Vref is defined by:

$$Tc=(1/V\text{ref})\times(\Delta V\text{ref}/\Delta T)$$

Accordingly, the temperature coefficient Tc of the output voltage Vref is given by 1/T, and becomes about +0.33%/° C. at a room temperature (about 300° K.).

In the LED element formed of a GaAlAs element and used in the LED head, the temperature dependence of the light emission power is about −0.25%/° C. A temperature dependence of a reference resistor 53 (refer to FIG. 23) disposed in the IC driver formed through a CMOS process is about +0.1%/° C.

A temperature of the LED element is about the same as a temperature of the IC driver arranged adjacent to the LED element. Further, the LED elements and the conventional reference voltage generation circuit 37 may be arranged on a ground wiring portion formed on a print circuit board, so that each of the LED elements has a similar temperature.

Accordingly, in order to compensate the reduction in the light emission power upon an increase in the temperature of the LED elements, it is suffice that the reference voltage Vref has the following temperature coefficient:

$$-(-0.25-0.1)=+0.35\%/^\circ\text{ C.}$$

The temperature coefficient thus obtained is about the same as the temperature coefficient of the conventional reference voltage generation circuit 37.

FIGS. 24(*a*) and 24(*b*) are graphs showing a property of the conventional reference voltage generation circuit 37. More specifically, FIG. 24(*a*) is a graph showing a relationship between the output voltage Vref and the power source voltage VDD, and FIG. 24(*b*) is a graph showing a relationship between a power source voltage dependence of the output voltage Vref and the power source voltage VDD.

As shown in FIG. 24(*a*), the output voltage Vref is established when the power source voltage VDD becomes grater than 2 V (VDD >2 V). Further, the output voltage Vref increases when the power source voltage VDD increases. In FIG. 24(*b*), the power source voltage dependence of the output voltage Vref is defined by:

$$1/V\text{ref}\times(\Delta V\text{ref}/\Delta V\text{DD})\times 100\ (\%/\text{V})$$

As shown in FIG. 24(*b*), the output voltage Vref shows the power source voltage dependence of about 2%/° C. at the power source voltage VDD of 5 V. When the power source voltage VDD decreases upon driving the LED elements, the output voltage Vref decreases, thereby reducing the drive current of the LED elements. As disclosed in Patent Reference, the bipolar transistor has a small early voltage. Accordingly, as shown in FIG. 24(*b*), the output voltage Vref is dependent on the power source voltage VDD and varies.

When the power source voltage VDD increases, a gate potential of the PMOS transistor M2 (refer to FIG. 23) increases for maintaining a drain current thereof at a specific level. Accordingly, a collector potential of the bipolar transistor Q2 increases. When the bipolar transistor Q2 has a sufficiently large early voltage, the increase in the collector current becomes negligibly small, thereby maintaining a current value flowing through the bipolar transistor Q2 at a specific level.

In an actual case, the bipolar transistor Q2 does not have a sufficiently large early voltage. Accordingly, when the collector potential of the bipolar transistor Q2 increases, the collector current thereof also increases. Further, when the collector current of the bipolar transistor Q2 increases, a drain current of the PMOS transistor M2 increases. As a result, a drain current of the PMOS transistor M3 having the current-mirror relationship with the PMOS transistor M2 increases, thereby increasing the output voltage Vref.

As described above, it is preferred that the bipolar transistor Q2 has a sufficiently large early voltage. However, the bipolar transistor Q2 is produced concurrently when a semiconductor IC having a CMOS structure is produced. Accordingly, it is difficult to specifically adjust the property of the bipolar transistor Q2.

FIG. 25 is a circuit diagram showing another conventional reference voltage generation circuit 38.

As shown in FIG. 25, PMOS transistor M4, M5, and M6 with a same size have source terminals connected to the power source VDD and gate terminals connected to each other, thereby constituting a current-mirror circuit. A drain terminal of the PMOS transistor M4 is connected to a collector terminal and a base terminal of an NPN bipolar transistor Q3. The NPN bipolar transistor Q3 has an emitter connected to ground.

A drain terminal of the PMOS transistor M5 is connected to a base terminal and a collector terminal of an NPN bipolar transistor Q4 through a resistor 63. The NPN bipolar transistor Q4 has an emitter terminal connected to ground. The NPN bipolar transistor Q4 has an emitter area N times larger than an emitter area of the NPN bipolar transistor Q3 (N>1).

A drain terminal of the PMOS transistor M6 is connected to ground through a resistor 64. A connection point of the drain terminal of the PMOS transistor M6 and the resistor 64 becomes an output terminal of the conventional reference voltage generation circuit 38 for outputting the reference voltage Vref.

A reverse input terminal of a operational amplifier 61 is connected to a base terminal of the NPN bipolar transistor Q3, and a non-reverse input terminal thereof is connected to a drain terminal of the PMOS transistor M5. An output terminal of amplifier 61 is connected to gate terminals of the PMOS transistors M4 to M6. The resistors 63 and 64 have resistivities of R3 and R4, respectively.

In the conventional reference voltage generation circuit 38 shown in FIG. 25, when it is assumed that a collector current of the bipolar transistor is negligible relative to a base current, the output voltage Vref of the conventional reference voltage generation circuit 38 is given by:

$$Vref=(R4/R3)\times(kT/q)\ln(N)$$

Where k is the Boltzmann constant, T is an absolute temperature, q is a charge of electron, and ln represents natural legalism.

It is supposed that the temperature coefficient Tc of the output voltage Vref is defined by:

$$Tc=(1/Vref)\times(\Delta Vref/\Delta T)$$

Accordingly, the temperature coefficient Tc of the output voltage Vref is given by 1/T, and becomes about +0.33%/° C. at a room temperature (about 300° K.).

FIGS. 26(*a*) and 26(*b*) are graphs showing a property of the conventional reference voltage generation circuit 38. More specifically, FIG. 26(*a*) is a graph showing a relationship between the output voltage Vref and the power source voltage VDD, and FIG. 26(*b*) is a graph showing a relationship between a power source voltage dependence of the output voltage Vref and the power source voltage VDD.

As shown in FIG. 26(*a*), the output voltage Vref is established when the power source voltage VDD becomes grater than 2 V (VDD>2 V). Further, the output voltage Vref increases when the power source voltage VDD increases. In FIG. 24(*b*), the power source voltage dependence of the output voltage Vref is defined by:

$$1/Vref\times(\Delta Vref/\Delta VDD)\times 100\ (\%/V)$$

As shown in FIG. 26(*b*), the output voltage Vref shows the power source voltage dependence of about 0.8%/° C. at the power source voltage VDD of 5 V. When the power source voltage VDD decreases upon driving the LED elements, the output voltage Vref decreases, thereby reducing the drive current of the LED elements.

As shown in FIG. 25, the conventional reference voltage generation circuit 38 is provided with the operational amplifier 65 for controlling an output terminal potential thereof, so that a terminal potential of the non-reverse input terminal becomes substantially equal to that of the reverse input terminal. In an actual case, however, due to a variance in a semiconductor production process and the likes, a small offset voltage is generated between the non-reverse input terminal and the reverse input terminal of the operational amplifier 65.

When a small offset voltage is generated, the output voltage Vref (refer to FIGS. 26(*a*) and 26(*b*)) is shifted from an ideal state. Accordingly, when the offset voltage varies due to a variance in a semiconductor production process and the likes, the output voltage Vref varies, thereby causing a problem.

FIG. 27 is a graph showing a relationship between the output voltage Vref and the offset voltage. In FIG. 27, the horizontal axis represents the offset voltage of the operational amplifier 65, and the vertical axis represents the output voltage Vref.

As shown in FIG. 27, when the offset voltage is merely a few mV, the output voltage Vref varies significantly. Accordingly, it is necessary to reduce a variance in a semiconductor production process for maintaining a specific reference voltage. As a result, it is difficult to obtain a high production yield for the drive IC, thereby increasing a production cost thereof, and eventually a production cost of the LED head and the printer.

In the LED head, even though the temperature varies associated with the LED rive, it is necessary to maintain the light emission power at a specific level. Accordingly, it is necessary to provide a driving method capable of compensating the temperature dependence of the light emission power of the LED elements.

In the conventional reference voltage generation circuit 37 shown in FIG. 23, it is possible to maintain the specific temperature coefficient through obtaining a value proportional to the absolute temperature as the output voltage. However, the output voltage has the power source voltage dependence of about 2%/V at the power source voltage of 5 V. Accordingly, when the power source voltage decreases upon the LED drive, the output voltage Vref decreases, thereby decreasing the LED drive current. As a result, the light emission power decreases and exposure energy to the photosensitive drum of the printer decreases, thereby reducing a print density.

In the conventional reference voltage generation circuit 38 shown in FIG. 25, the output voltage has the power source voltage dependence of about 0.8%/V at the power source voltage of 5 V, thereby showing somehow improvement from the conventional reference voltage generation circuit 37 shown in FIG. 23, but not sufficient.

Besides, the conventional reference voltage generation circuit 38 shown in FIG. 25 is provided with the operational amplifier 65, thereby inevitably generating the offset voltage of the operational amplifier 65. Accordingly, even when the offset voltage of a few mV is generated, the output voltage Vref significantly varies. As a result, the semiconductor production process needs to have high accuracy. Consequently, the production yield of the drive IC decreases, thereby increasing the production cost of the drive IC, and eventually the production cost of the LED head and the printer.

In view of the problems described above, an object of the present invention is to provide a reference voltage generation circuit capable of solving the problems of the conventional drive circuit. Another object of the present invention is to provide a drive circuit, a print head, and an image forming apparatus having the reference voltage generation circuit.

The reference voltage generation circuit of the present invention is provided for compensating a negative temperature dependence of light emission power of an LED element and a temperature dependence of a reference resistor in a driver IC. The reference voltage generation circuit of the present invention does not vary significantly relative to a change in a power source voltage, and has a minimized influence against a variance in semiconductor production process.

Further objects and advantages of the invention will be apparent from the following description of the invention.

SUMMARY OF THE INVENTION

In order to attain the objects described above, according to a first aspect of the present invention, a reference voltage generation circuit includes a current-mirror circuit formed of a plurality of MOS (Metal Oxide Semiconductor) transistors each having a source terminal connected to a power source and a gate terminal connected to with each other; and a plurality of transistors each connected to a drain terminal of each of the MOS transistors of the current-mirror circuit for controlling the current-mirror circuit, so that an output current of the current-mirror circuit is converted to a voltage to be output as a reference voltage. Each of the MOS transistors of the current-mirror circuit has the drain terminal connected to a collector terminal of each of the transistors. Accordingly, when a voltage of the power source varies, it is possible to maintain a collector current of each of the transistors at a specific level and a collector current of each of the transistors constant.

According to a second aspect of the present invention, a reference voltage generation circuit includes a current-mirror circuit formed of a first MOS (Metal Oxide Semiconductor) transistor and a second MOS (Metal Oxide Semiconductor) transistor each having a gate terminal connected to with each other; a first bipolar transistor and a second bipolar transistor each connected to a drain terminal of each of the first MOS transistor and the second MOS transistor of the current-mirror circuit for controlling the current-mirror circuit; and a operational amplifier for adjusting collector currents of the first bipolar transistor and the second bipolar transistor at a substantially same level, so that an output current of the current-mirror circuit is converted to a voltage to be output as a reference voltage. The second bipolar transistor has a base terminal connected to a collector of the first bipolar transistor.

According to a third aspect of the present invention, a drive circuit includes a reference voltage generation circuit for outputting a reference voltage to adjust a drive current for driving a driven element according to the reference voltage.

The reference voltage generation circuit includes a current-mirror circuit formed of a plurality of MOS (Metal Oxide Semiconductor) transistors each having a source terminal connected to a power source and a gate terminal connected to with each other; and a plurality of transistors each connected to a drain terminal of each of the MOS transistors of the current-mirror circuit for controlling the current-mirror circuit, so that an output current of the current-mirror circuit is converted to a voltage to be output as a reference voltage. Each of the MOS transistors of the current-mirror circuit has the drain terminal connected to a collector terminal of each of the transistors. Accordingly, when a voltage of the power source varies, it is possible to maintain a collector voltage of each of the transistors at a specific level and a collector current of each of the transistors constant.

According to a fourth aspect of the present invention, a print head includes a reference voltage generation circuit for outputting a reference voltage to adjust a drive current for driving a driven element according to the reference voltage.

The reference voltage generation circuit includes a current-mirror circuit formed of a plurality of MOS (Metal Oxide Semiconductor) transistors each having a source terminal connected to a power source and a gate terminal connected to with each other; and a plurality of transistors each connected to a drain terminal of each of the MOS transistors of the current-mirror circuit for controlling the current-mirror circuit, so that an output current of the current-mirror circuit is converted to a voltage to be output as a reference voltage. Each of the MOS transistors of the current-mirror circuit has the drain terminal connected to a collector terminal of each of the transistors. Accordingly, when a voltage of the power source varies, it is possible to maintain a collector current of each of the transistors at a specific level and a collector current of each of the transistors constant.

According to a fifth aspect of the present invention, an image forming apparatus includes a reference voltage generation circuit for outputting a reference voltage to adjust a drive current for driving a driven element according to the reference voltage.

The reference voltage generation circuit includes a current-mirror circuit formed of a plurality of MOS (Metal Oxide Semiconductor) transistors each having a source terminal connected to a power source and a gate terminal connected to with each other; and a plurality of transistors each connected to a drain terminal of each of the MOS transistors of the current-mirror circuit for controlling the current-mirror circuit, so that an output current of the current-mirror circuit is converted to a voltage to be output as a reference voltage. Each of the MOS transistors of the current-mirror circuit has the drain terminal connected to a collector terminal of each of the transistors. Accordingly, when a voltage of the power source varies, it is possible to maintain a collector current of each of the transistors at a specific level and a collector current of each of the transistors constant.

In the present invention, when a voltage of the power source varies, an output voltage of the reference voltage generation circuit does not vary to a large extent. Accordingly, it is possible to obtain a configuration, in which the drive current for driving the driven element does not vary to a large extent, and it is possible to minimize an influence of a variance in a semiconductor production process.

DETAILED DESCRIPTION OF PREFERRED EMBODIMENTS

Figure 1:
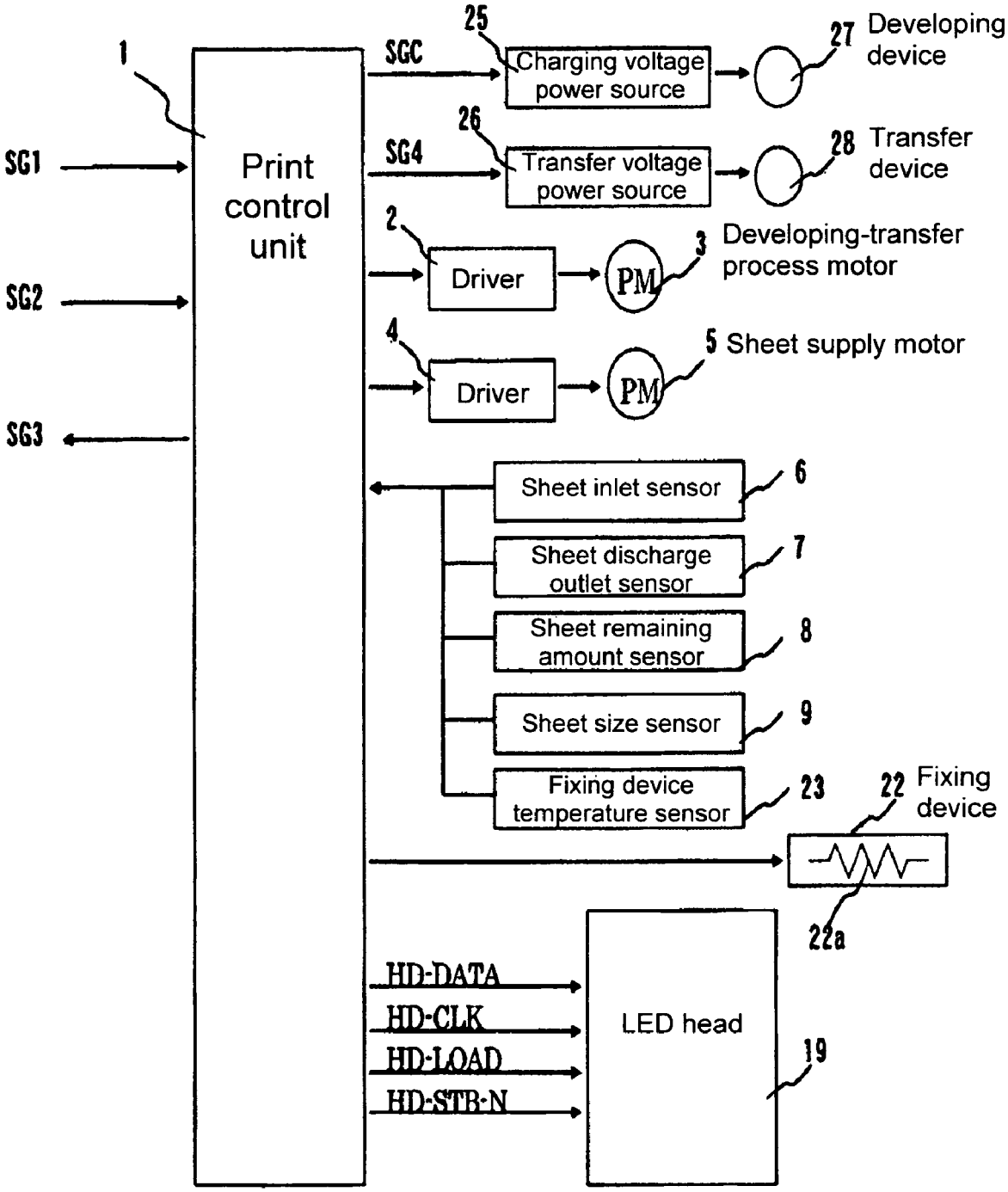
FIG. 1 is a block diagram showing a configuration of an electro-photography printer according to a first embodiment of the present invention.

Hereunder, preferred embodiments of the present invention will be explained with reference to the accompanying drawings. Similar components in the drawings are designated with the same reference numerals.

First Embodiment

Figure 2:
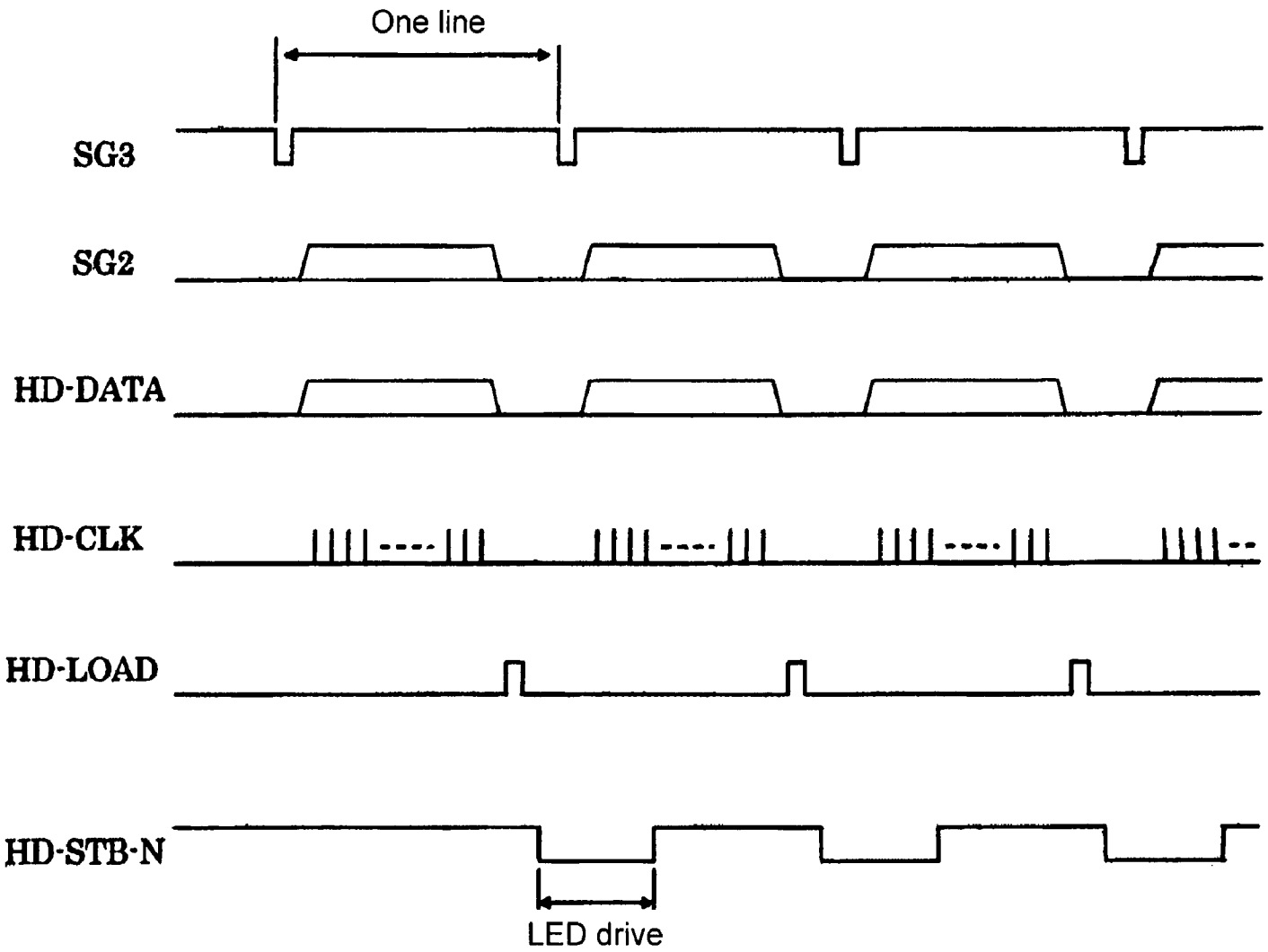
FIG. 2 is a time chart showing an operation of the electro-photography printer according to the first embodiment of the present invention.

A first embodiment of the present invention will be explained. FIG. 1 is a block diagram showing a configuration of an electro-photography printer according to the first embodiment of the present invention. FIG. 2 is a time chart showing an operation of the electro-photography printer according to the first embodiment of the present invention. In the following description, a reference voltage generation circuit provided in the electro-photography printer will be explained as an example.

As shown in FIG. 1, the electro-photography printer includes a print control unit 1 formed of a microprocessor, an RAM, an ROM, an input-output port, a timer, and the likes. The print control unit 1 is disposed in a printing unit of the electro-photography printer for performing a sequence control of an entire portion of the electro-photography printer and a printing operation according to a control signal SG1 from an upper controller (not shown), a video signal SG2 (in which dot map data are arranged one-dimensionally), and the likes.

When the print control unit 1 receives a print direction along with the control signal SG1, the print control unit 1 first detects whether a fixing device 22 with a heater 22*a* disposed therein is within an operatable temperature range using a fixing device temperature sensor 23. When the fixing device 22 is not within the operatable temperature range, the print control unit 1 energizes the heater 22*a* to heat the fixing device 22 up to an operatable temperature.

In the next step, the print control unit 1 controls a developing-transfer process motor (PM) 3 to rotate through a driver 2. At the same time, the print control unit 1 turns on a charging voltage power source 25 with a charge signal SGC, thereby charging a developing device 27.

In the next step, a sheet remaining amount sensor 8 and a sheet size sensor 9 detect a sheet (not shown) and a size thereof, and the sheet is transported. A sheet supply motor (PM) 5 is capable of rotating in two directions through a driver 4. The sheet supply motor (PM) 5 rotates in a reverse direction to transport the sheet for a specific distance until a sheet inlet sensor 6 detects the sheet. Then, the sheet supply motor (PM) 5 rotates in a forward direction to transport the sheet into a printing mechanism in the electro-photography printer.

As shown in FIGS. 1 and 2, when the sheet reaches a printable position, the print control unit 1 sends a timing signal SG3 (including a main scanning synchronization signal and a sub scanning synchronization signal) to the upper controller, and the print control unit 1 receives the video signal SG2 from the upper controller. The upper controller edits the video signal SG2 per page. When the print control unit 1 receives the video signal SG2, the print control unit 1 sends the video signal SG2 as a print data signal HD-DATA to an LED (Light Emitting Diode) head 19. The LED head 19 is formed of a plurality of LED elements arranged therein each for printing one dot (pixel).

When the print control unit 1 receives the video signal SG2 for one line, the print control unit 1 sends a latch signal HD-LOAD to the LED head 19, so that the print data signal HD-DATA is stored in the LED head 19. Note that the print control unit 1 is capable of printing the print data signal HD-DATA stored in the LED head 19 while the print control unit 1 receives a next video signal SG2 from the upper controller. A clock signal HD-CLK is also sent to the LED head 19 for sending the print data signal HD-DATA.

In the embodiment, the video signal SG2 is sent and received per print line. Information to be printed with the LED head 19 is converted to a static latent image on a photosensitive drum (not shown) charged with a negative potential as a dot with an increased potential. In the developing device 27, toner charged with a negative potential is attracted to each dot through an electric attraction force, thereby forming a toner image.

In the next step, the sheet is transported to a transfer device 28. A transfer voltage power source 26 becomes a negative potential with a transfer signal SG4, so that the transfer device 28 transfers the toner image to the sheet passing between the photosensitive drum and the transfer device 28.

After the toner image is transferred to the sheet, the sheet abuts against the fixing device 22 with the heater 22*a* disposed therein, and is transported further, thereby fixing the toner image to the sheet through heat of the fixing device 22. After the toner image is fixed to the sheet, the sheet is transported further, and is discharged to outside the printer after passing through a sheet discharge outlet sensor 7.

In the embodiment, the print control unit 1 applies a voltage from the transfer voltage power source 26 to the transfer device 28 only when the sheet passes through the transfer device 28 according to detections of the sheet size sensor 9 and the sheet inlet sensor 6. After the printing operation is performed, the print control unit 1 stops the voltage from the charging voltage power source 25 to the developing device 27, and stops the developing-transfer process motor 3. Afterward, the operation described above is repeated.

Figure 3:
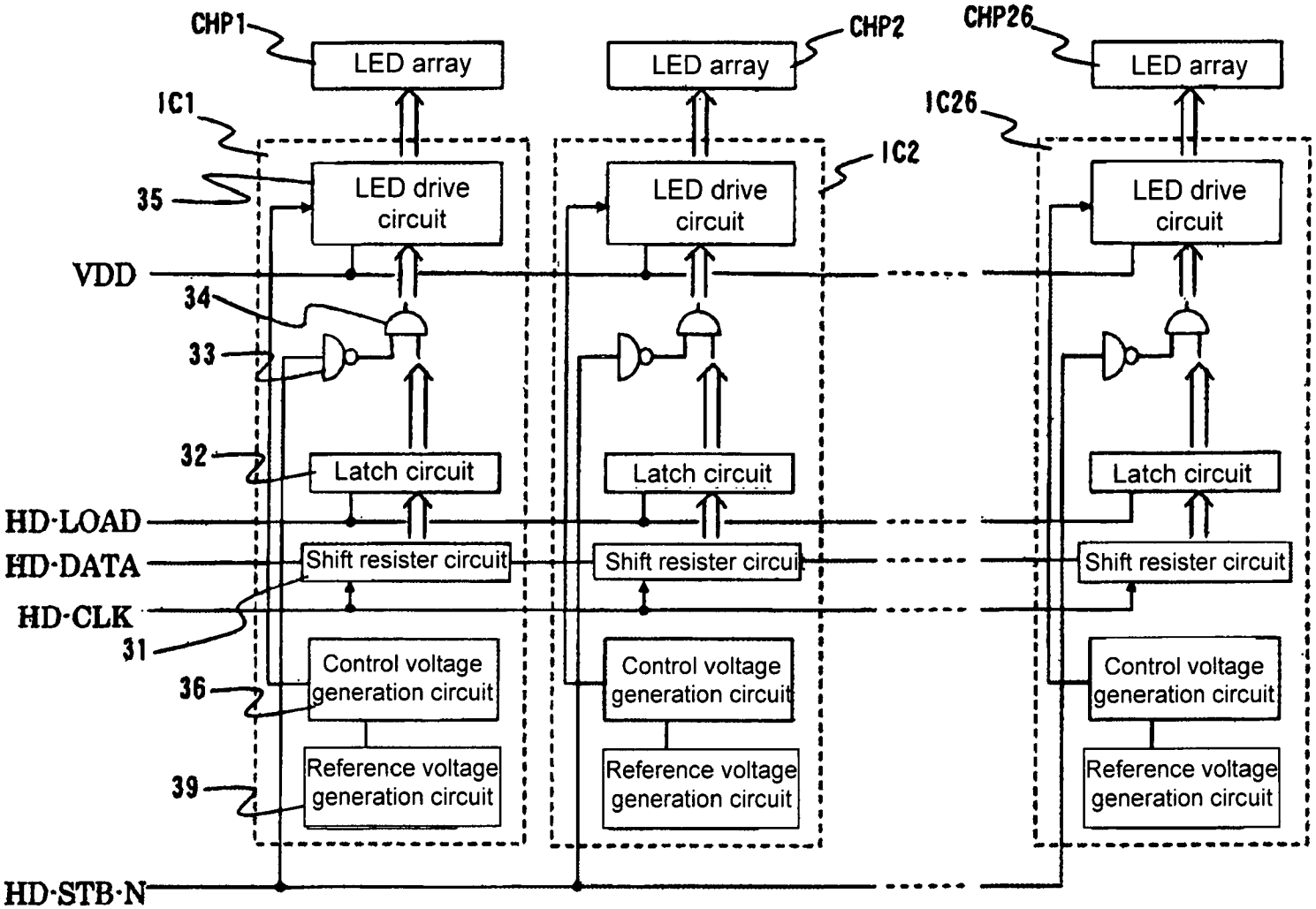
FIG. 3 is a block diagram showing a configuration of an LED (Light Emitting Diode) head according to the first embodiment of the present invention.

A configuration of the LED (Light Emitting Diode) head 19 will be explained next. FIG. 3 is a block diagram showing the configuration of the LED head 19 according to the first embodiment of the present invention.

In the following description, as an example, the LED head 19 is capable of printing on a sheet with A-4 size at a resolution of 600 dots per one inch. In the embodiment, the LED head 19 includes a total of 4992 dots of the LED elements. More specifically, the LED head 19 includes 26 of LED arrays, and each LED array is formed of 192 of the LED elements.

As shown in FIG. 3, the LED head 19 includes LED arrays CHP1 and CHP26, and LED arrays CHP2 to CHP25 are omitted in FIG. 3. Driver ICs IC1 and IC 26 are arranged to correspond to the LED arrays CHP1 and CHP26 for driving the LED arrays CHP1 and CHP26, respectively. The driver ICs IC1 and IC 26 are formed of an identical circuit, and adjacent driver ICs are connected in a cascade connection.

In the LED head 19 shown in FIG. 3, 26 of the LED arrays (CHP1 to CHP26) and 26 of the driver ICs (IC1 to IC26) for driving the LED arrays are arranged on a print circuit board (not shown) to face each other. One chip of the driver IC is capable of driving 192 of the LED elements, and 26 chips of the driver ICs are connected in a cascade connection for transmitting in serial print data input from outside.

In the embodiment, each of the driver ICs (IC1 to IC26) is formed of an identical circuit, and adjacent driver ICs are connected in a cascade connection.

In the embodiment, each of the driver ICs includes a shift resister circuit 31 for receiving the clock signal HD-CLK and performing shift transfer of print data; a latch circuit 32 for latching an output signal of the shift resister circuit 31 according to a latch signal (referred to as HD-LOAD); an AND circuit 34 for receiving outputs of the latch circuit 32 and an inverter circuit 33 to obtain a logic product; an LED drive circuit 35 for supplying a drive current from a power source VDD to the LED element (CHP1 etc.) according to an output signal of the AND circuit 34; and a control voltage generation circuit 36 for generating a control voltage, so that the drive current of the LED drive circuit 35 becomes constant. A strobe signal HD-STB-N is input to the inverter circuit 33.

Further, a reference voltage generation circuit 39 is provided such that an output terminal thereof is connected to the control voltage generation circuit 36 of each of the driver ICS IC1 to IC26 for supplying a reference voltage Vref. Note that when the printing operation is performed, the print control unit 1 sends the print data signal HD-DATA, the clock signal HD-CLK, the latch signal HD-LOAD, and the strobe signal HD-STB-N.

Figure 4:
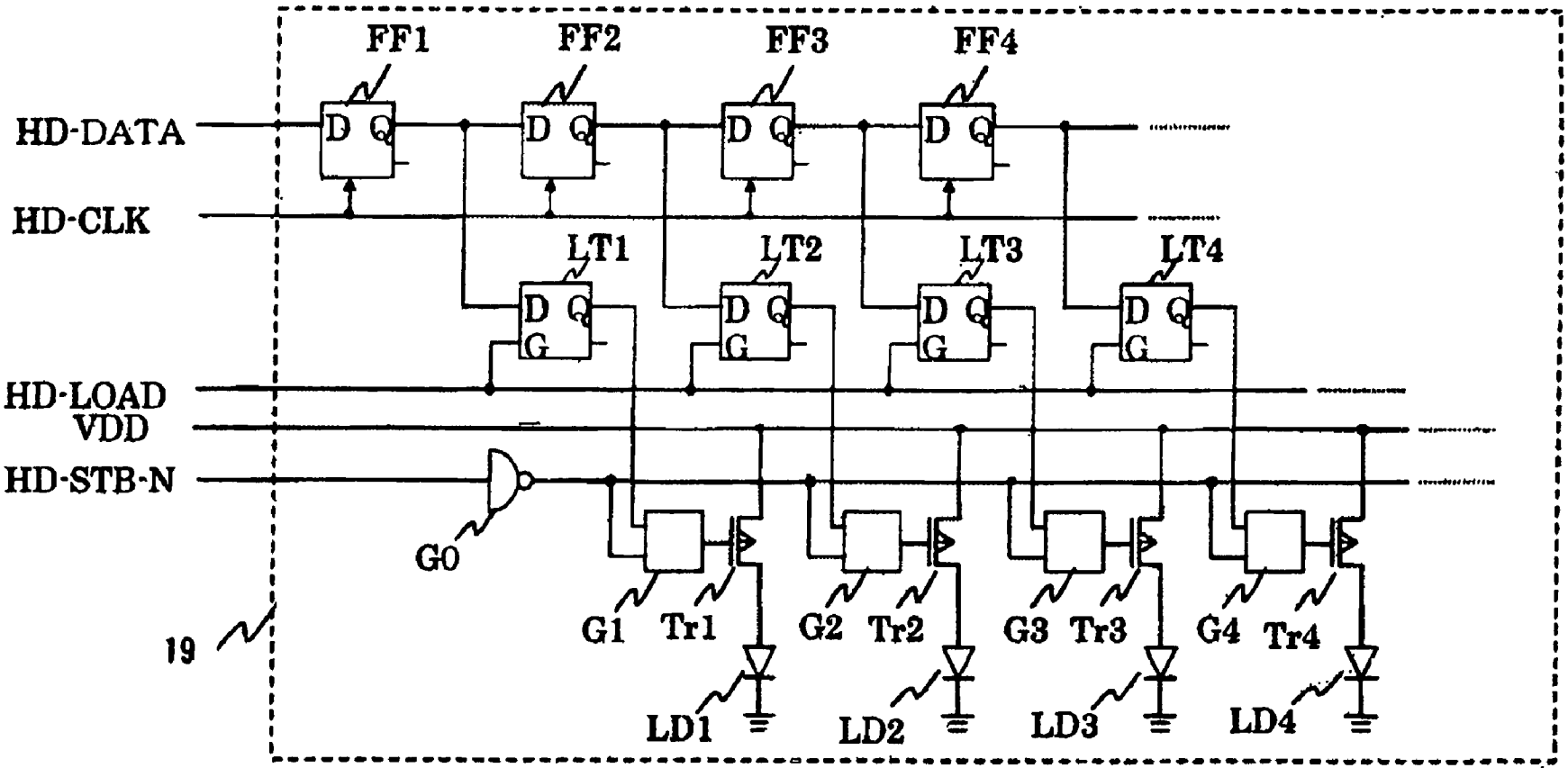
FIG. 4 is a simplified circuit diagram of the configuration of the LED head according to the first embodiment of the present invention.

FIG. 4 is a simplified circuit diagram of the configuration of the LED head shown in FIG. 3 according to the first embodiment of the present invention. As shown in FIG. 4, both the print data signal HD-DATA and the clock signal HD-CLK are input to the LED head 19. In the printer, bit data of 4992 dots are transmitted through a shift resister formed of flip-flop circuits FF1 to FF4992.

Then, the latch signal HD-LOAD is input to the LED head 19, so that the bit data are latched to latch circuits LT1 to LT4992. Afterward, ones among the LED elements LD1 to LED4992 corresponding to the dot data at a high level emit light according to the bit data and the strobe signal HD-STB-N. As shown in FIG. 4, an inverter circuit GO; pre-buffer circuits G1 to G4992; switch elements Tr1 to Tr4992; and the power source VDD are further provided.

Figure 5:
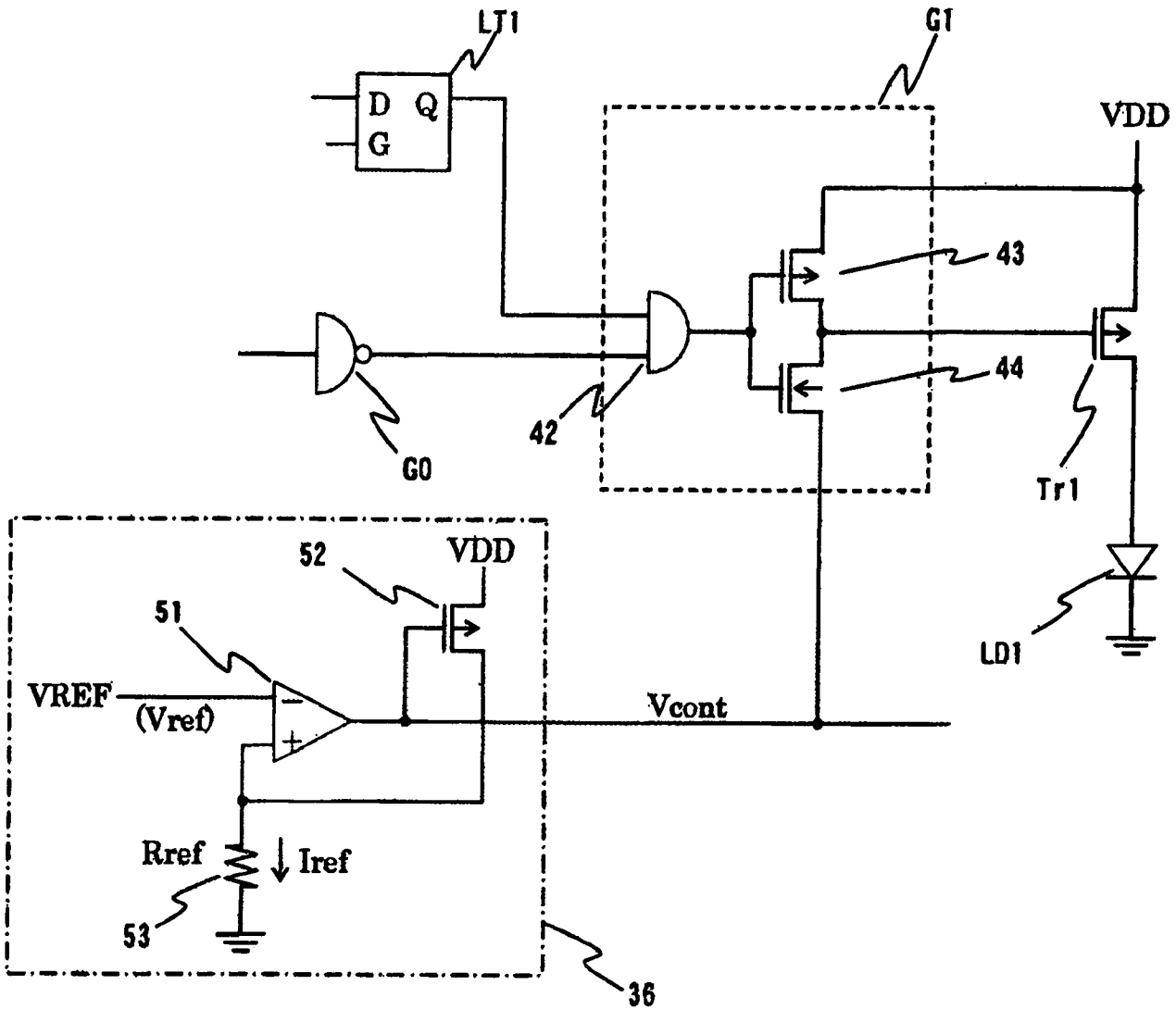
FIG. 5 is a circuit diagram showing a LED drive main portion of a driver IC (Integrated Circuit) according to the first embodiment of the present invention.

FIG. 5 is a circuit diagram showing a LED drive main portion of a driver IC (Integrated Circuit) according to the first embodiment of the present invention. A connection relationship between an LED drive circuit and a peripheral circuit thereof is shown in FIG. 5. In FIG. 5, the dot 1 (for example, a surrounding area of a drive circuit of the LED 1) is shown as an example.

As described above, the LED drive current is determined based on the reference voltage generated in the driver IC. In the following description, an operation of the driver IC will be explained.

As shown in FIG. 5, the pre-buffer circuit G1 indicated with a hidden line is formed of an AND circuit 42, a PMOS transistor 43, and an NMOS transistor 44. The inverter circuit G0 and the latch circuit LT1 are also provided. The control voltage generation circuit 36 is indicated with a projected line, and one control voltage generation circuit 36 is provided per one driver IC chip.

In the embodiment, a operational amplifier 51 outputs an output voltage Vcont to be applied to the LED drive transistor Tr1 for adjusting the drive current of the LED element. A resistor 53 has a resistivity of Rref. A PMOS transistor 52 has a gate length the same as that of the LED drive transistor Tr1.

In the embodiment, a reverse input terminal of the operational amplifier 51 is connected to a reference voltage input terminal VREF, so that the reference voltage Vref generated at the reference voltage generation circuit 39 (described later) is input thereto. Note that the operational amplifier 51, the PMOS transistor 52, and the resistor 53 constitute a feedback circuit. A current Iref flowing through the resistor 53, that is, flowing through the PMOS transistor 52, is not depended on the power source voltage VDD, and is determined only by the reference voltage Vref and the resistivity Rref of the resistor 53.

In the embodiment, the operational amplifier 51 controls such that a potential of the reverse input terminal thereof becomes equal to a potential of a non-reverse input terminal thereof. Accordingly, the current Iref flowing through the resistor 53 is given by:

$$Iref=Vref/Rref$$

As described above, it is configured such that the PMOS transistor 52 has the gate length the same as that of the LED drive transistor Tr1. A gate potential thereof becomes equal to Vcont upon driving the LED element. Accordingly, the PMOS transistor 52 and the LED drive transistor Tr1 operate in a saturated region, and have a current-mirror relationship.

As a result, the drive current value of the LED element LD1 is proportional to the current Iref flowing through the resistor 53, and the current Iref is proportional to the reference voltage Vref input into the VREF terminal. Accordingly, it is possible to collectively adjust the LED drive current according to the reference voltage Vref. The resistor 53 is produced through a semiconductor process technology. In general, the resistor 53 is formed of a resistor element such as poly-silicon or an impurity diffused resistor, and is integrated in the driver IC in a form of monolithic.

Figure 6:
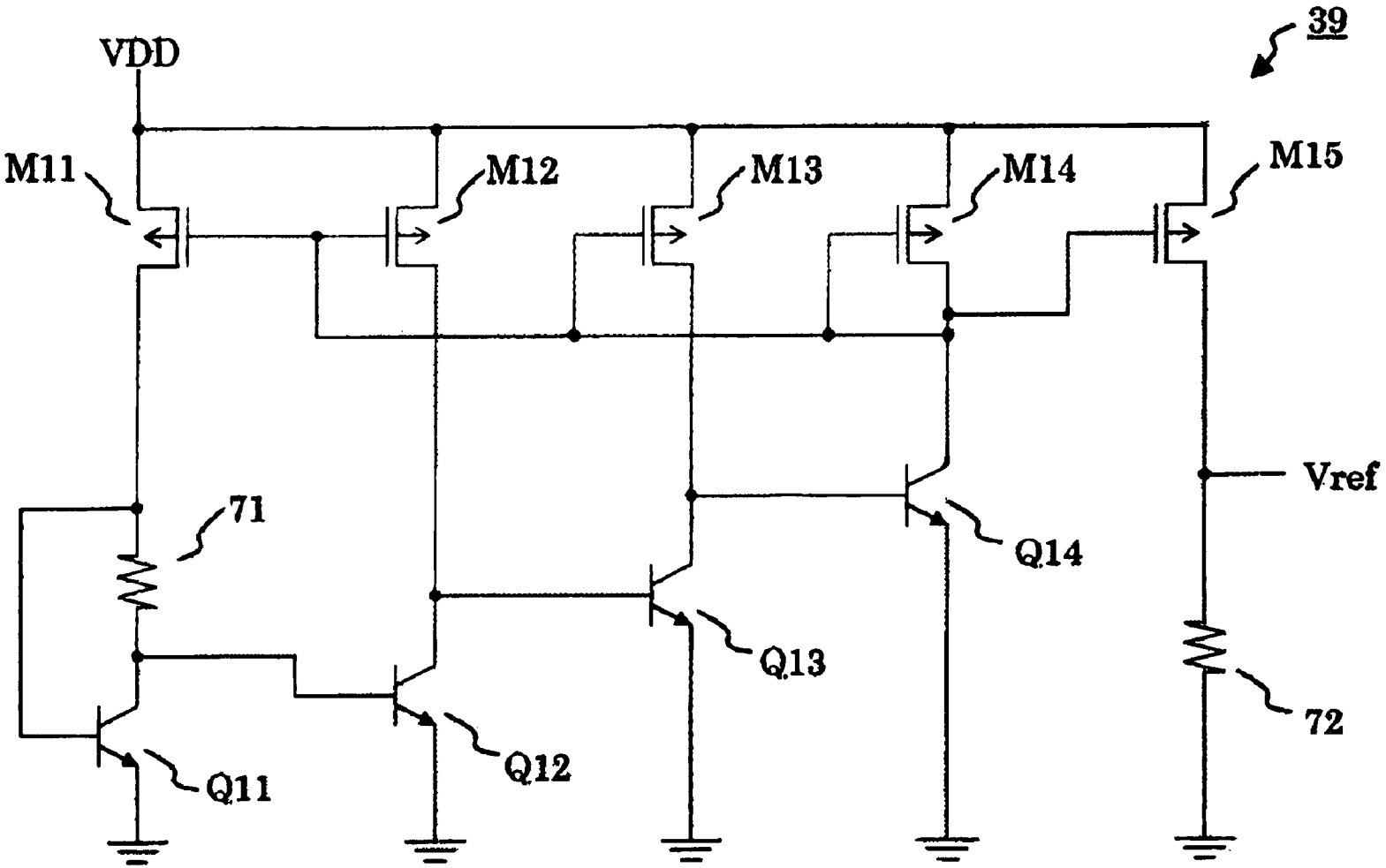
FIG. 6 is a circuit diagram showing a configuration of a reference voltage generation circuit according to the first embodiment of the present invention.

FIG. 6 is a circuit diagram showing a configuration of the reference voltage generation circuit 39 shown in FIG. 3 according to the first embodiment of the present invention.

As shown in FIG. 6, the reference voltage generation circuit 39 includes P-channel MOS (PMOS) transistors M11 to M15; NPN bipolar transistors Q11 to Q14; and resistors 71 and 72. The PMOS transistors M11 to M15 have source terminals connected to the power source VDD and gate terminals connected to each other and a drain terminal of the PMOS transistor M14. A drain terminal of the PMOS transistor M11 is connected to a base terminal of the bipolar transistor Q11 and one end portion of the resistor 71. The other end portion of the resistor 71 is connected to a collector terminal of the bipolar transistor Q11.

In the embodiment, a drain terminal of the PMOS transistor M12 is connected to a collector terminal of the bipolar transistor Q12. A base terminal of the bipolar transistor Q12 is a collector terminal of the bipolar transistor Q11. A drain terminal of the PMOS transistor M13 is connected to a collector terminal of the bipolar transistor Q13. A base terminal of the bipolar transistor Q13 is connected to a collector terminal of the bipolar transistor Q12. A drain terminal of the PMOS transistor M14 is connected to a collector terminal of the bipolar transistor Q14. A base terminal of the bipolar transistor Q14 is connected to a collector terminal of the bipolar transistor Q13.

In the embodiment, a drain terminal of the PMOS transistor M15 is connected to one end portion of the resistor 72. The other end portion of the resistor 72 is connected to ground. Emitter terminals of the bipolar transistors Q11 to Q14 are connected to ground. The drain terminal of the PMOS transistor M15 is connected to the output terminal Vref for applying the reference voltage Vref to the control voltage generation circuit 36 shown in FIG. 5.

The NPN bipolar transistor Q12 has an emitter area N times larger than an emitter area of the NPN bipolar transistor Q11 (N>1). It is possible to set an arbitrary emitter area for the NPN bipolar transistors Q13 and Q14. It is preferable to set the emitter area for the NPN bipolar transistors Q13 and Q14 substantially the same as that of the bipolar transistor Q11.

Figure 7:
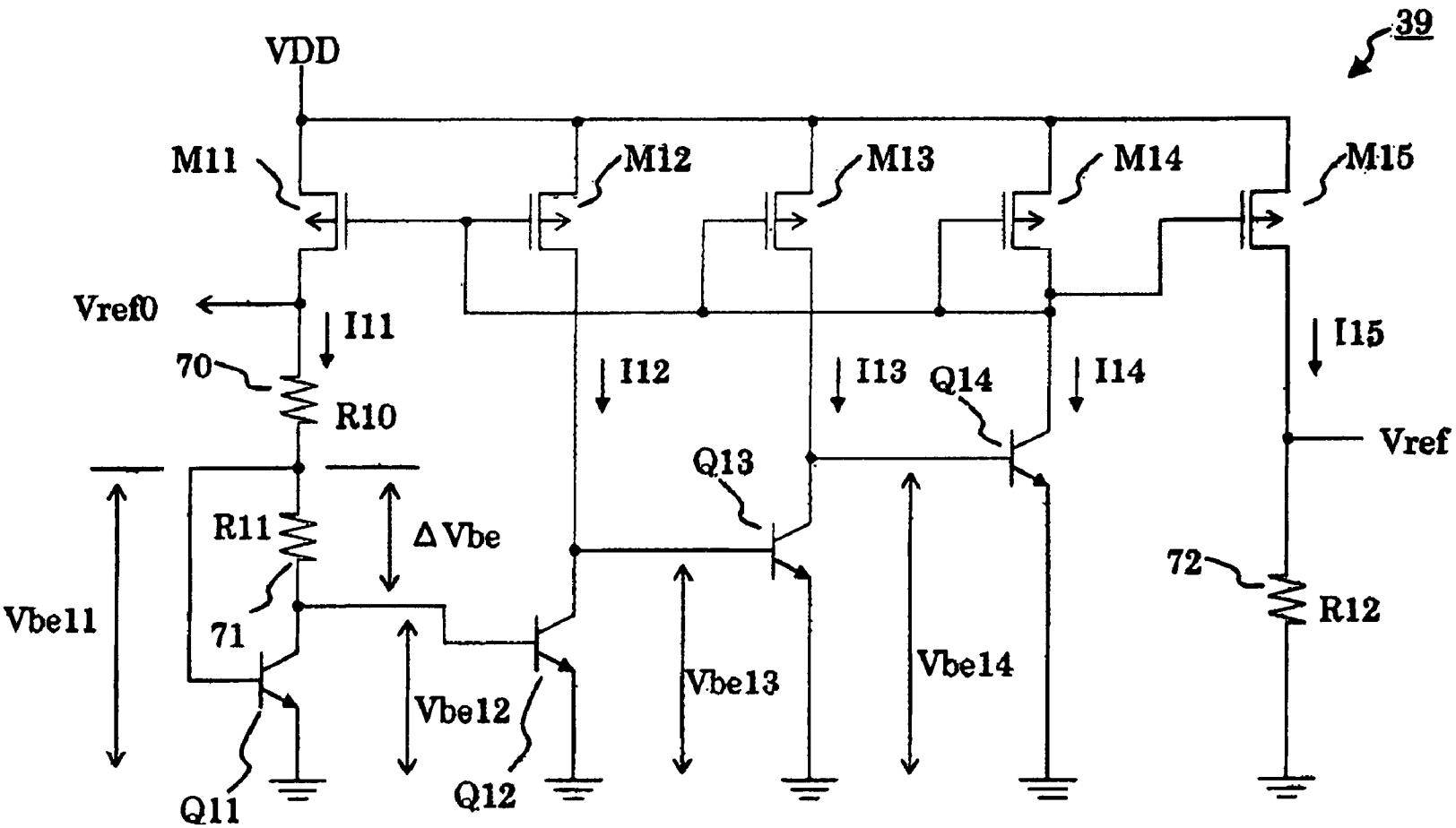
FIG. 7 is a circuit diagram showing an operation of the reference voltage generation circuit according to the first embodiment of the present invention.

An operation of the reference voltage generation circuit 39 will be explained next. FIG. 7 is a circuit diagram showing an operation of the reference voltage generation circuit 39 according to the first embodiment of the present invention. In FIG. 7, for the sake of the explanation, the resistors 71 and 72 have resistivities of R11 and R12. Further, a resistor 70 with a resistivity of R10 is disposed between the resistor 71 and the drain terminal of the PMOS transistor M11.

The source terminals and the gate terminals of the PMOS transistor M11 to M15 are connected to with each other, and have a current-mirror relationship, in which a gate length and a gate width thereof are set to be identical. As a result, the PMOS transistors M11 to M15 shown in FIG. 7 have about the same drain currents I11 to I15.

In order to determine the output voltage Vref shown in FIG. 7, the drain current I11 of the PMOS transistor M11 is determined first. As well known in electric physics, an emitter current Ie and a base-emitter voltage Vbe of a bipolar transistor have the following relationship, $$Ie \approx Is \times \exp(qVbe/(kT))$$

where Is is a saturated current that is a constant determined to be proportional to an element area of a bipolar transistor, exp() is an exponential function, q is a charge of electron, i.e., $q=1.6\times10^{-19}$ C, k is the Boltzmann constant, i.e., $k=1.38\times10^{-23}$ J/K, and T is an absolute temperature, i.e., T=298 K at a room temperature 23° C.

Through modifying the equation shown above, the following equation is obtained, $$Vbe=(kT/q)\times\ln(Ie/Is)$$

where in represents natural legalism.

It is supposed that the bipolar transistors Q11 and Q12 have base-emitter voltages of Vbe11 and Vbe12, emitter currents of Ie11 and Ie12, and saturated currents of Is11 and Is12. Accordingly, the following equations are established, $$Vbe11=(kT/q)\times\ln(Ie11/Is11)$$

$$Vbe12=(kT/q)\times\ln(Ie12/Is12)$$

As shown in FIG. 7, one end portion of the resistor 71 has a potential of Vbe11, and the other end portion of the resistor 71 has a potential of Vbe12. Accordingly, a potential difference ΔVbe applied to both end portions of the resistor 71 is given by, $$\Delta Vbe = Vbe11 - Vbe12$$

When the equations are combined, the following equation is obtained, $$\Delta Vbe = (kT/q)\times[\ln(Ie11/Is11) - \ln(Ie12/Is12)]$$
$$= (kT/q)\times\ln[(Is12/Is11)\times\ln(Ie11/Ie12)]$$

As described above, a ratio of the emitter areas of the bipolar transistors Q11 and Q12 is 1 to N. Further, the saturated current is proportional to an element area of a transistor. Accordingly, the following relationship is established, $$Is12=Is11\times N$$

As described above, the PMOS transistors M11 to M15 have the current-mirror relationship, so that the drain currents Ill to I15 thereof are identical. Accordingly, the emitter currents Ie11 and Ie12 of the bipolar transistors Q11 and Q12 are identical, and the following equation is established, $$\Delta Vbe=(kT/q)\times\ln(N)$$

Further, the drain current I11 of the PMOS transistor M11 is equal to a current flowing through the resistor 71. Accordingly, the following equation is established, $$I11=\Delta Vbe/R11=(1/R11)\times(kT/q)\times\ln(N)$$

In the embodiment, the collector terminal of the bipolar transistor Q12 is connected to the base terminal of the bipolar transistor Q13, and the collector terminal of the bipolar transistor Q12 has a potential the same as a base-emitter voltage Vbe13 of the bipolar transistor Q13. The collector terminal of the bipolar transistor Q13 is connected to the base terminal of the bipolar transistor Q14, and the collector terminal of the bipolar transistor Q13 has a potential the same as a base-emitter voltage Vbe14 of the bipolar transistor Q14. The collector terminal of the bipolar transistor Q14 is connected to the gate terminal of the PMOS transistor M14.

When the power source voltage VDD increases, the gate potentials of the PMOS transistors M11 to M15 increase to maintain the drain current I11 of the PMOS transistor M11. The collector potentials of the bipolar transistors Q12 and Q13 are maintained at levels of the base-emitter voltages Vbe13 and Vbe14, and do not fluctuate to a large extent. Accordingly, even when the bipolar transistor Q12 has a low early voltage, the collector potential thereof is maintained at the base-emitter voltage Vbe13, thereby minimizing a variance in the collector current.

When the power source voltage VDD increases, or the drain current I11 of the PMOS transistor M11 increases slightly due to an influence of an external noise, the base-emitter voltage Vbe11 of the bipolar transistor Q11 increases slightly and the collector current of the bipolar transistor Q11 increases. Accordingly, the voltage decrease at the resistor 71 increases, and the collector potential of the bipolar transistor Q11 decreases. At this time, the collector potential of the bipolar transistor Q11 is equal to the base-emitter voltage Vbe12 of the bipolar transistor Q12. Accordingly, the collector potential of the bipolar transistor Q12 increases slightly.

Further, the collector potential of the bipolar transistor Q12 is equal to the base-emitter voltage Vbe13 of the bipolar transistor Q13. Accordingly, the collector potential of the bipolar transistor Q13 decreases slightly. Still further, the collector potential of the bipolar transistor Q13 is equal to the base-emitter voltage Vbe14 of the bipolar transistor Q14. Accordingly, the collector potential of the bipolar transistor Q14 increases slightly.

As described above, the collector terminal of the bipolar transistor Q14 is connected to the gate terminals of the PMOS transistors M11 to M15. Accordingly, when the collector potential of the bipolar transistor Q14 increases, gate-source voltages of the PMOS transistors M11 to M15 decrease. As a result, there occurs a feedback of reducing the drain current I11 of the PMOS transistor M11, thereby canceling the slight increase in the drain current I11 of the PMOS transistor M11, i.e., a starting point of the feedback.

In the embodiment, the drain current I11 of the PMOS transistor M11 is equal to the drain current I15 of the PMOS transistor M15 (I11=I15). As described above, the drain current I11 of the PMOS transistor M11 is given by, $$I11=\Delta Vbe/R11=(1/R11)\times(kT/q)\times\ln(N)$$

At this time, the output voltage Vref is equal to a product of the drain current I15 and the resistivity R12 (Vref=I15×R12). Accordingly, the output voltage Vref of the reference voltage generation circuit 39 is given by, $$Vref=(R12/R11)\times(kT/q)\times\ln(N)$$

According to the above equation, the output voltage Vref is proportional to the absolute temperature T, and the temperature coefficient at a room temperature becomes about +0.33%/V.

A potential Vref0 shown in FIG. 7 is given by, $$Vref0=I11\times R10+Vbell=(R10/R11l)\times(kT/q)\times\ln(N)+Vbell$$

A first term of the above equation shows a positive temperature coefficient relative to the absolute temperature, and a second term of the above equation, i.e., a temperature coefficient of the base-emitter voltage of the bipolar transistor, becomes about −2.2%/V, i.e., a negative dependence. Accordingly, it is possible to set a temperature dependence of the potential Vref0 at about zero through properly setting a ratio of the resistivity R10 and R11.

Figure 8:
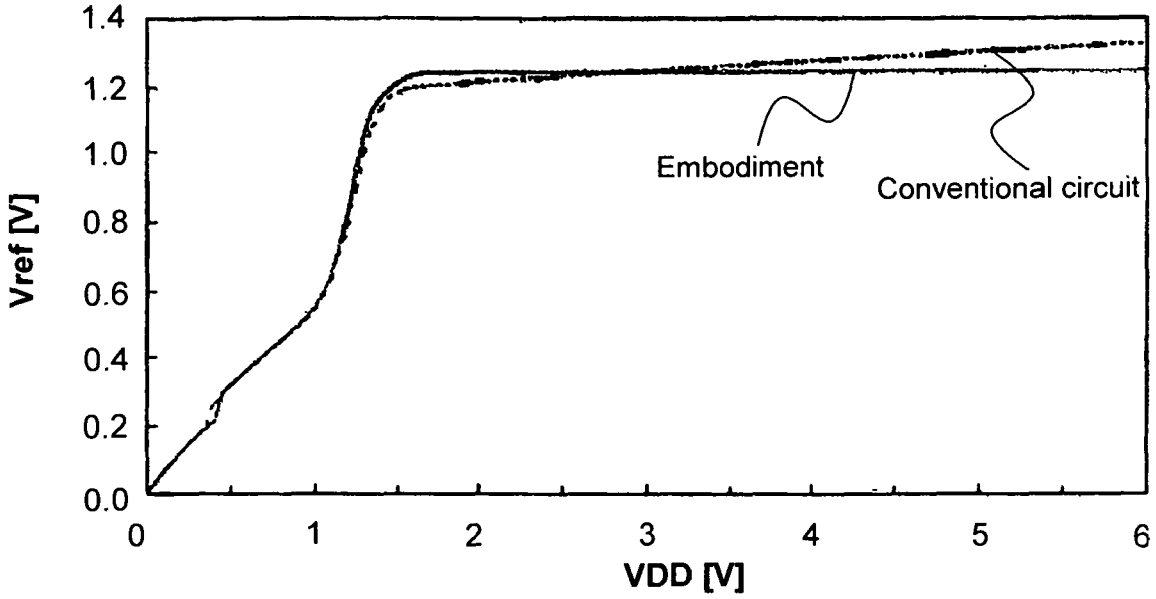
FIGS. 8(*a*) and 8(*b*) are graphs showing a property of the reference voltage generation circuit according to the first embodiment of the present invention, wherein FIG. 8(*a*) is a graph showing a relationship between an output voltage Vref and a power source voltage VDD, and FIG. 8(*b*) is a graph showing a relationship between a power source voltage dependence of the output voltage Vref and the power source voltage VDD.
Figure 8:
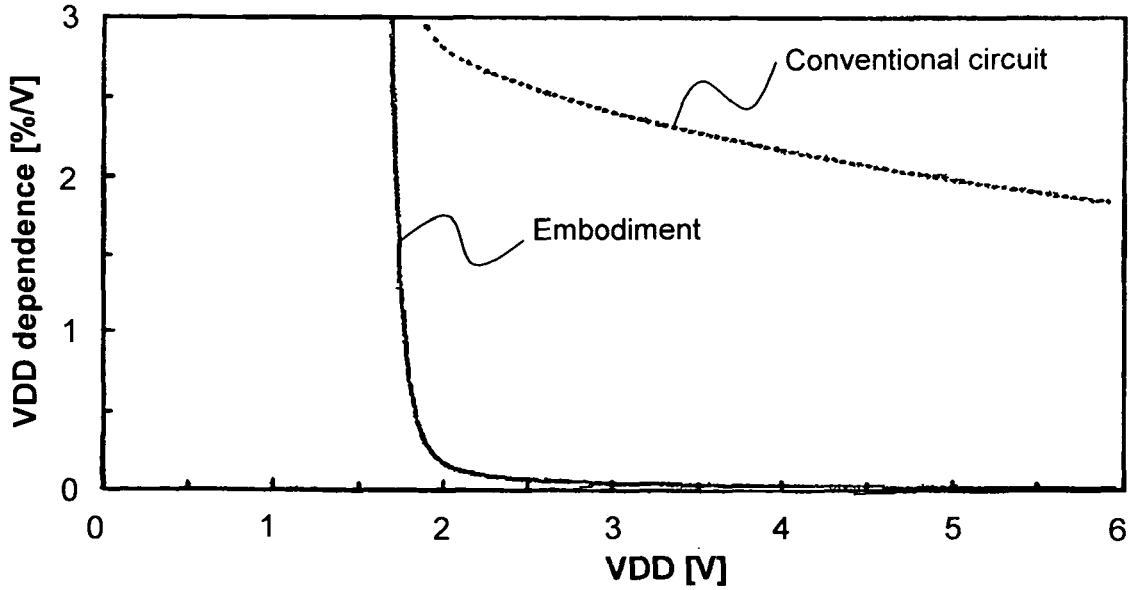
Figure 23:
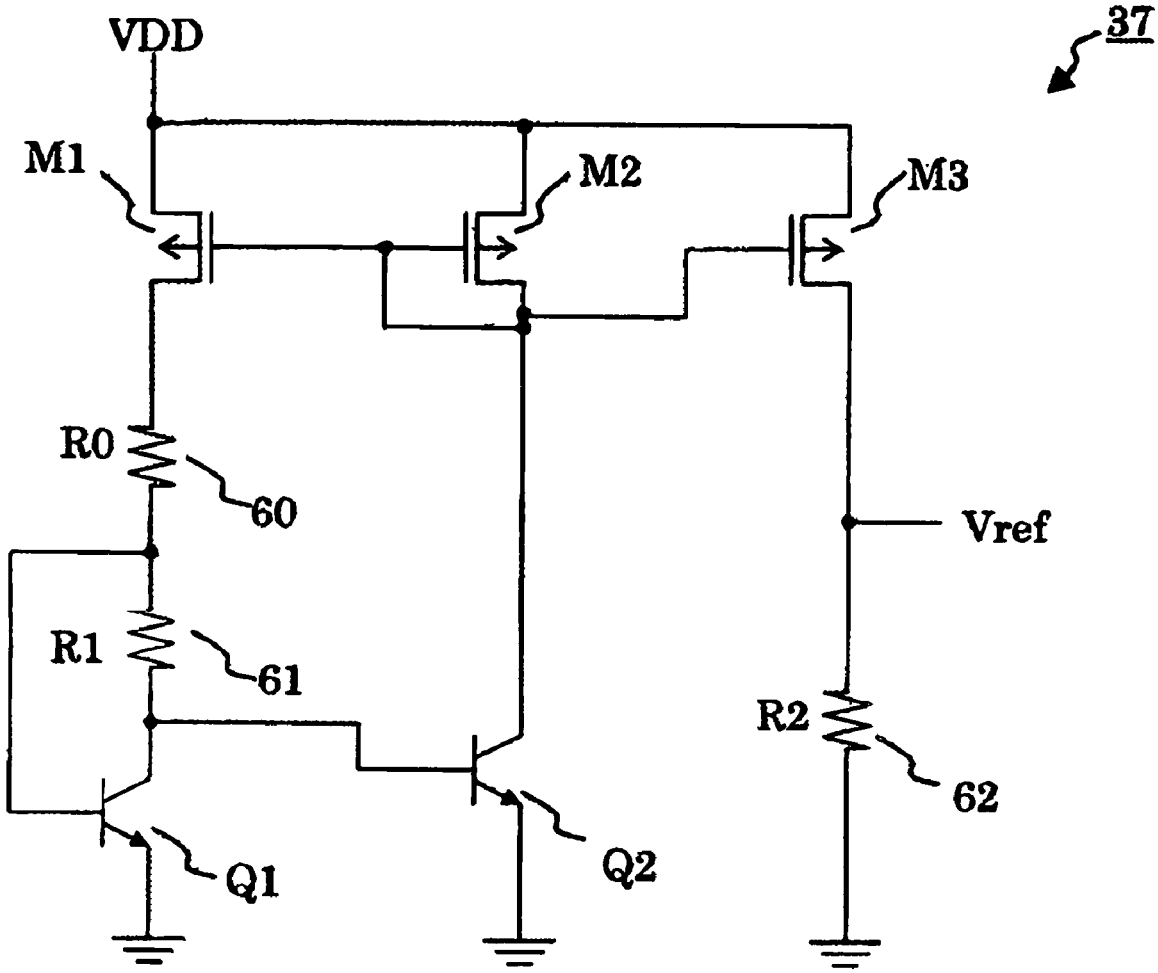
FIG. 23 is a circuit diagram showing a conventional reference voltage generation circuit.

FIGS. 8(*a*) and 8(*b*) are graphs showing a property of the reference voltage generation circuit 39 according to the first embodiment of the present invention. FIGS. 8(*a*) and 8(*b*) show a simulation result. A simulation result of a conventional circuit shown in FIG. 23 is indicated with a hidden line for comparison, and a simulation result of the reference voltage generation circuit 39 is indicated with a solid line.

FIG. 8(*a*) is a graph showing a relationship between an output voltage Vref and a power source voltage VDD. In FIG. 8(*a*), the horizontal axis represents the power source voltage VDD, and the vertical axis represents the output voltage Vref.

As shown in FIG. 8(*a*), the output voltage Vref is established when the power source voltage VDD becomes grater than 2 V (VDD>2 V). In the conventional circuit (hidden line), the output voltage Vref increases when the power source voltage VDD increases. In the reference voltage generation circuit 39 (solid line), the output voltage Vref is maintained constant when the power source voltage VDD increases.

FIG. 8(*b*) is a graph showing a relationship between a power source voltage dependence of the output voltage Vref and the power source voltage VDD. In FIG. 8(*b*), the power source voltage dependence of the output voltage Vref is defined by:

$$1/Vref\times(\Delta Vref/\Delta VDD)\times100(\%/V)$$

As shown in FIG. 8(*b*), in the conventional circuit (hidden line), the output voltage Vref shows the power source voltage dependence of about 2.0%/° C. at the power source voltage VDD of 5 V. On the other hand, in the reference voltage generation circuit 39, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements.

As explained above, in the conventional circuit, the output voltage Vref shows the power source voltage dependence of about 2.0%/° C. at the power source voltage VDD of 5 V. On the other hand, in the reference voltage generation circuit 40, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements. As a result, it is possible to perform the printing operation at a constant print density.

Second Embodiment

Figure 9:
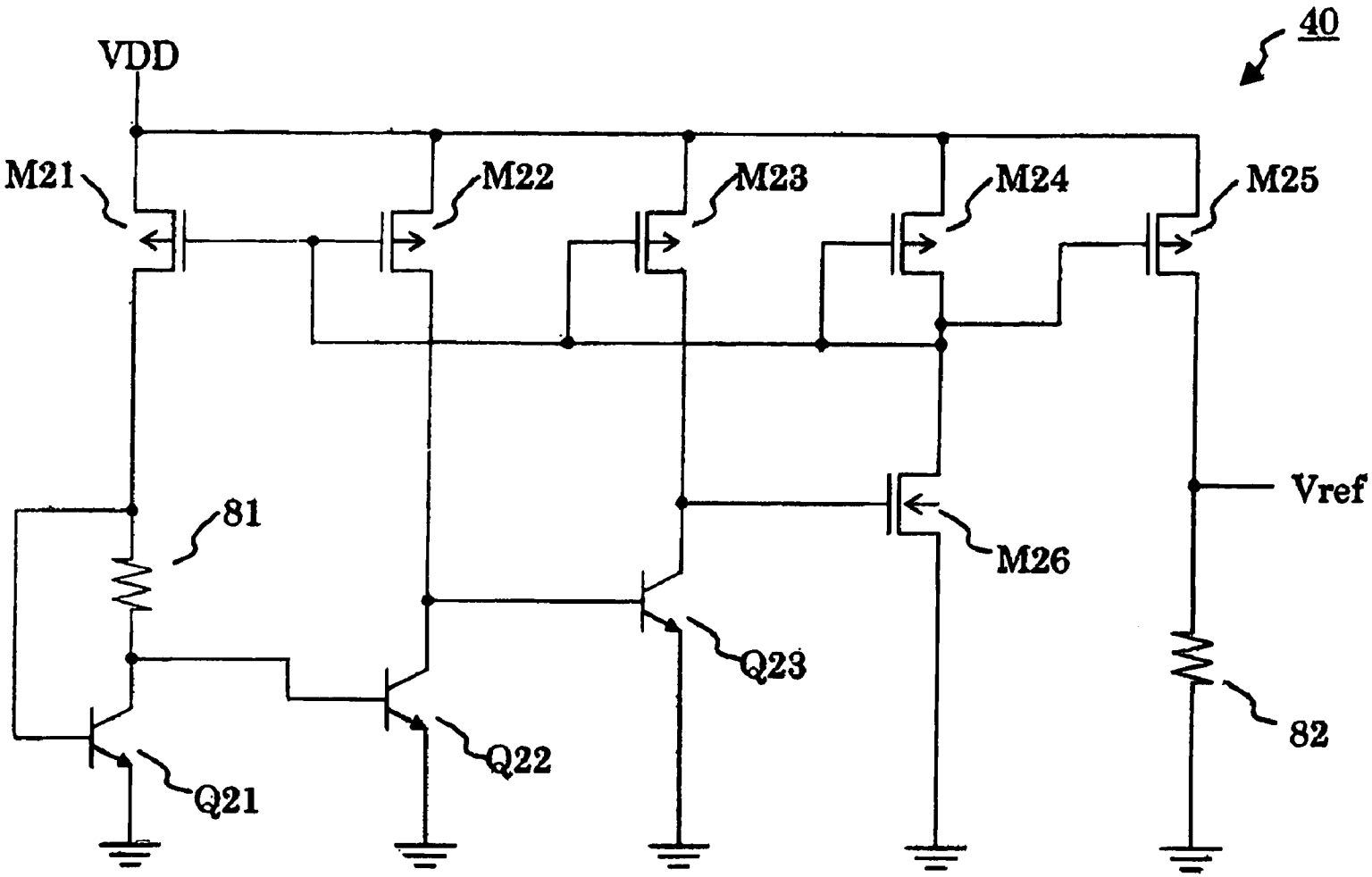
FIG. 9 is a circuit diagram showing a configuration of a reference voltage generation circuit according to a second embodiment of the present invention.

A second embodiment of the present invention will be explained next. FIG. 9 is a circuit diagram showing a configuration of a reference voltage generation circuit 40 according to the second embodiment of the present invention.

As shown in FIG. 9, the reference voltage generation circuit 40 includes PMOS transistor M21 to M25; an NMOS transistor M26; NPN bipolar transistors Q21 to Q23; and resistors 81 and 82. The PMOS transistors M11 to M15 have source terminals connected to the power source VDD and gate terminals connected to each other and a drain terminal of the PMOS transistor M24.

In the embodiment, a drain terminal of the PMOS transistor M21 is connected to a base terminal of the bipolar transistor Q21 and one end portion of the resistor 81. The other end portion of the resistor 81 is connected to a collector terminal of the bipolar transistor Q21. A drain terminal of the PMOS transistor M22 is connected to a collector terminal of the bipolar transistor Q22. A base terminal of the bipolar transistor Q22 is connected to a collector terminal of the bipolar transistor Q21. A drain terminal of the PMOS transistor M23 is connected to a collector terminal of the bipolar transistor Q23. A base terminal of the bipolar transistor Q23 is connected to a collector terminal of the bipolar transistor Q22.

In the embodiment, a drain terminal of the PMOS transistor M24 is connected to a drain terminal of the NMOS transistor M26. A gate terminal of the NMOS transistor M26 is connected to a collector terminal of the bipolar transistor Q23. A drain terminal of the PMOS transistor M25 is connected to one end portion of the resistor 82, and the other end portion of the resistor 82 is connected to ground. Emitter terminals of the bipolar transistors Q21 to Q23 are connected to ground. A source terminal of the NMOS transistor M26 is connected to ground.

In the embodiment, a drain terminal of the PMOS transistor M25 is connected to the output terminal Vref for applying the reference voltage Vref to the control voltage generation circuit 36 shown in FIG. 5. The NPN bipolar transistor Q22 has an emitter area N times larger than an emitter area of the NPN bipolar transistor Q21 (N>1). It is possible to set an arbitrary emitter area for the NPN bipolar transistor Q23. It is preferable to set the emitter area for the NPN bipolar transistor Q23 substantially the same as that of the bipolar transistor Q21.

Figure 10:
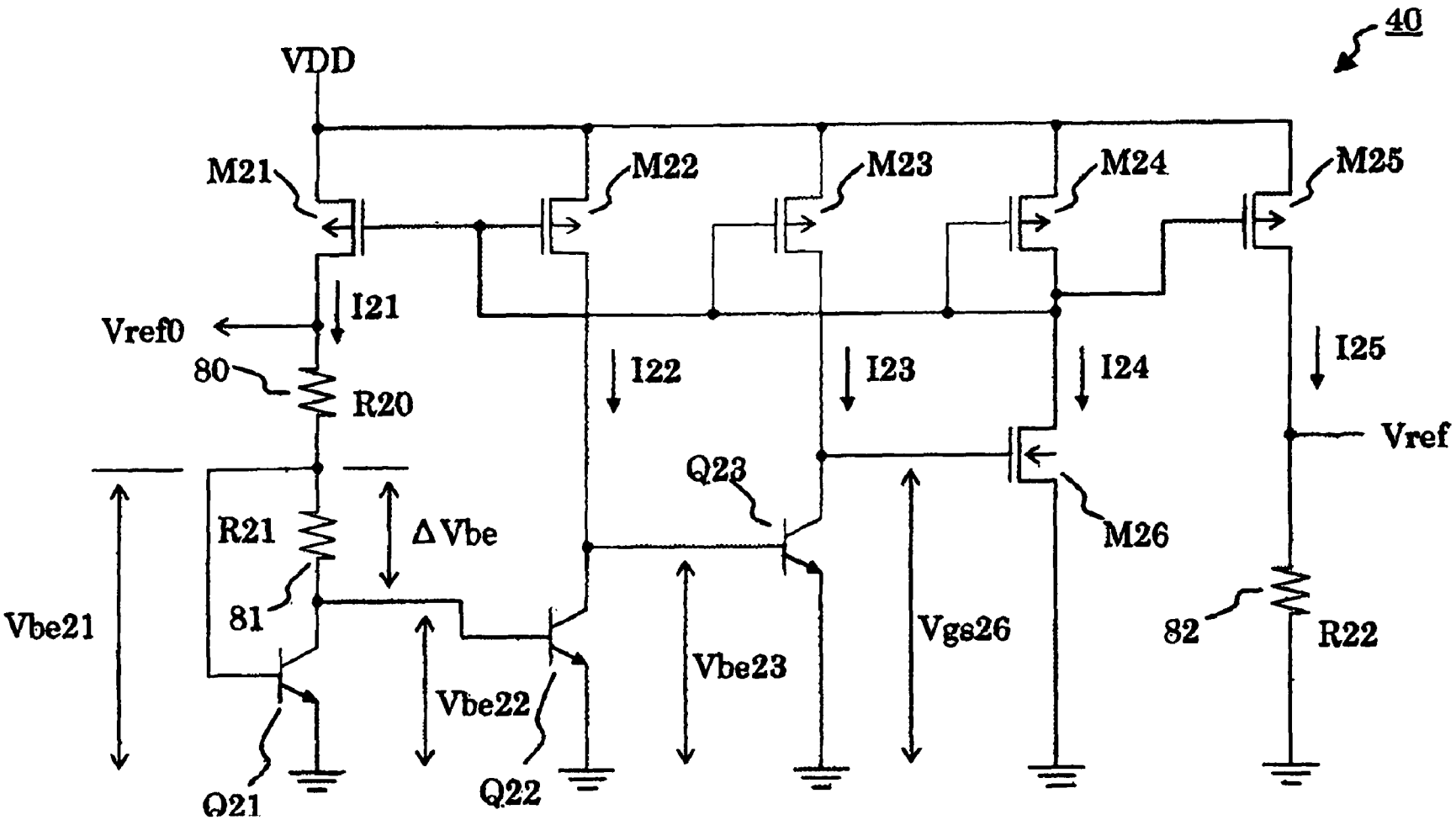
FIG. 10 is a circuit diagram showing an operation of the reference voltage generation circuit according to the second embodiment of the present invention.

An operation of the reference voltage generation circuit 40 will be explained next. FIG. 10 is a circuit diagram showing an operation of the reference voltage generation circuit 40 according to the second embodiment of the present invention. In FIG. 10, for the sake of the explanation, the resistors 81 and 82 have resistivities of R21 and R22. Further, a resistor 80 is disposed between the resistor 81 and the drain terminal of the PMOS transistor M21.

The source terminals and the gate terminals of the PMOS transistor M21 to M25 are connected to with each other, and have a current-mirror relationship, in which a gate length and a gate width thereof are set to be identical. As a result, the PMOS transistors M21 to M25 shown in FIG. 10 have about the same drain currents I21 to I25.

In order to determine the output voltage Vref shown in FIG. 10, the drain current I21 of the PMOS transistor M21 is determined first. As well known in electric physics, an emitter current Ie and a base-emitter voltage Vbe of a bipolar transistor have the following relationship, $$Ie \approx Is \times \exp(qVbe/(kT))$$

where Is is a saturated current that is a constant determined to be proportional to an element area of a bipolar transistor, expo is an exponential function, q is a charge of electron, i.e., $q=1.6\times10^{-19}$ C, k is the Boltzmann constant, i.e., $k=1.38\times10^{-23}$ J/K, and T is an absolute temperature, i.e., T=298 K at a room temperature 23° C.

Through modifying the equation shown above, the following equation is obtained, $$Vbe=(kT/q)\times\ln(Ie/Is)$$

where ln represents natural legalism.

It is supposed that the bipolar transistors Q21 and Q22 have base-emitter voltages of Vbe21 and Vbe22, emitter currents of Ie21 and Ie22, and saturated currents of Is21 and Is22. Accordingly, the following equations are established, $$Vbe21=(kT/q)\times\ln(Ie21/Is21)$$

$$Vbe22=(kT/q)\times\ln(Ie22/Is22)$$

As shown in FIG. 10, one end portion of the resistor 81 has a potential of Vbe21, and the other end portion of the resistor 81 has a potential of Vbe22. Accordingly, a potential difference ΔVbe applied to both end portions of the resistor 81 is given by, $$\Delta Vbe=Vbe21-Vbe22$$

When the equations are combined, the following equation is obtained, $$\begin{aligned}\Delta Vbe &= (kT/q)\times[\ln(Ie21/Is21)-\ln(Ie22/Is22)]\\ &= (kT/q)\times\ln[(Is22/Is21)\times\ln(Ie21/Ie22)]\end{aligned}$$

As described above, a ratio of the emitter areas of the bipolar transistors Q21 and Q22 is 1 to N. Further, the saturated current is proportional to an element area of a transistor. Accordingly, the following relationship is established, $$Is22=Is21\times N$$

As described above, the PMOS transistors M21 to M25 have the current-mirror relationship, so that the drain currents I21 to I25 thereof are identical. Accordingly, the emitter currents Ie21 and Ie22 of the bipolar transistors Q21 and Q22 are identical, and the following equation is established, $$\Delta Vbe=(kT/q)\times\ln(N)$$

Further, the drain current I21 of the PMOS transistor M21 is equal to a current flowing through the resistor 81. Accordingly, the following equation is established, $$I21=\Delta Vbe/R21=(1/R21)\times(kT/q)\times\ln(N)$$

In the embodiment, the collector terminal of the bipolar transistor Q22 is connected to the base terminal of the bipolar transistor Q23, and the collector terminal of the bipolar transistor Q22 has a potential the same as a base-emitter voltage Vbe23 of the bipolar transistor Q23. The collector terminal of the bipolar transistor Q23 is connected to the gate terminal of the NMOS transistor M26, and the collector terminal of the bipolar transistor Q23 has a potential the same as a gate-source voltage Vgs26 of the NMOS transistor M26. The drain terminal of the NMOS transistor M26 is connected to the gate terminal of the PMOS transistor M24.

When the power source voltage VDD increases, the gate potentials of the PMOS transistors M21 to M25 increase to maintain the drain current I21 of the PMOS transistor M21. The collector potentials of the bipolar transistors Q22 and Q23 are maintained at levels of the base-emitter voltage Vbe23 of the bipolar transistor Q23 and the gate-source voltage Vgs26 of the NMOS transistor M26, and do not fluctuate to a large extent. Accordingly, even when the bipolar transistor Q22 has a low early voltage, the collector potential thereof is maintained at the base-emitter voltage Vbe23, thereby minimizing a variance in the collector current.

When the power source voltage VDD increases, or the drain current I21 of the PMOS transistor M21 increases slightly due to an influence of an external noise, the base-emitter voltage Vbe21 of the bipolar transistor Q21 increases slightly and the collector current of the bipolar transistor Q21 increases. Accordingly, the voltage decrease at the resistor 81 increases, and the collector potential of the bipolar transistor Q21 decreases. At this time, the collector potential of the bipolar transistor Q21 is equal to the base-emitter voltage Vbe22 of the bipolar transistor Q22. Accordingly, the collector potential of the bipolar transistor Q22 increases slightly.

Further, the collector potential of the bipolar transistor Q22 is equal to the base-emitter voltage Vbe23 of the bipolar transistor Q23. Accordingly, the collector potential of the bipolar transistor Q23 decreases slightly. Still further, the collector potential of the bipolar transistor Q23 is equal to the gate-source voltage Vgs26 of the NMOS transistor M26. Accordingly, the drain potential of the NMOS transistor M26 increases slightly.

As described above, the drain terminal of the NMOS transistor M26 is connected to the gate terminals of the PMOS transistors M21 to M25. Accordingly, when the drain potential of the NMOS transistor M26 increases, gate-source voltages of the PMOS transistors M21 to M25 decrease. As a result, there occurs a feedback of reducing the drain current I21 of the PMOS transistor M21, thereby canceling the slight increase in the drain current I21 of the PMOS transistor M21, i.e., a starting point of the feedback.

In the embodiment, the drain current I21 of the PMOS transistor M21 is equal to the drain current I25 of the PMOS transistor M25 (I21=I25). As described above, the drain current I21 of the PMOS transistor M21 is given by, $$I21=\Delta Vbe/R21=(1/R21)\times(kT/q)\times\ln(N)$$

At this time, the output voltage Vref is equal to a product of the drain current I25 and the resistivity R22 (Vref=I25×R22). Accordingly, the output voltage Vref of the reference voltage generation circuit 40 is given by, $$Vref=(R22/R21)\times(kT/q)\times\ln(N)$$

According to the above equation, the output voltage Vref is proportional to the absolute temperature T, and the temperature coefficient at a room temperature becomes about +0.33%/V.

Figure 11:
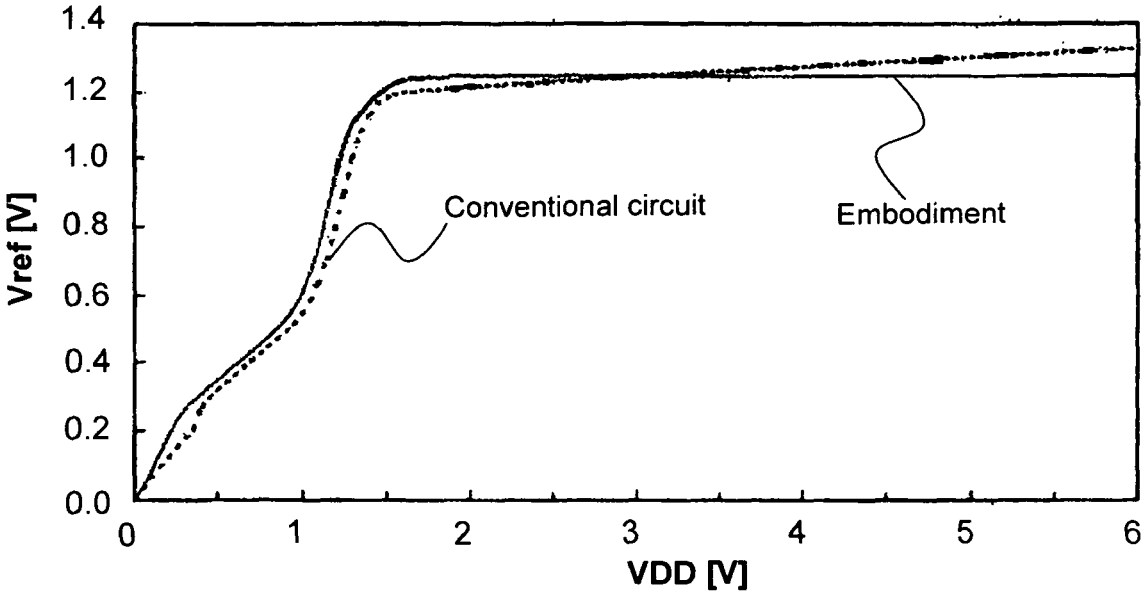
FIGS. 11(*a*) and 11(*b*) are graphs showing a property of the reference voltage generation circuit according to the second embodiment of the present invention, wherein FIG. 11(*a*) is a graph showing a relationship between the output voltage Vref and the power source voltage VDD, and FIG. 11(*b*) is a graph showing a relationship between a power source voltage dependence of the output voltage Vref and the power source voltage VDD.
Figure 11:
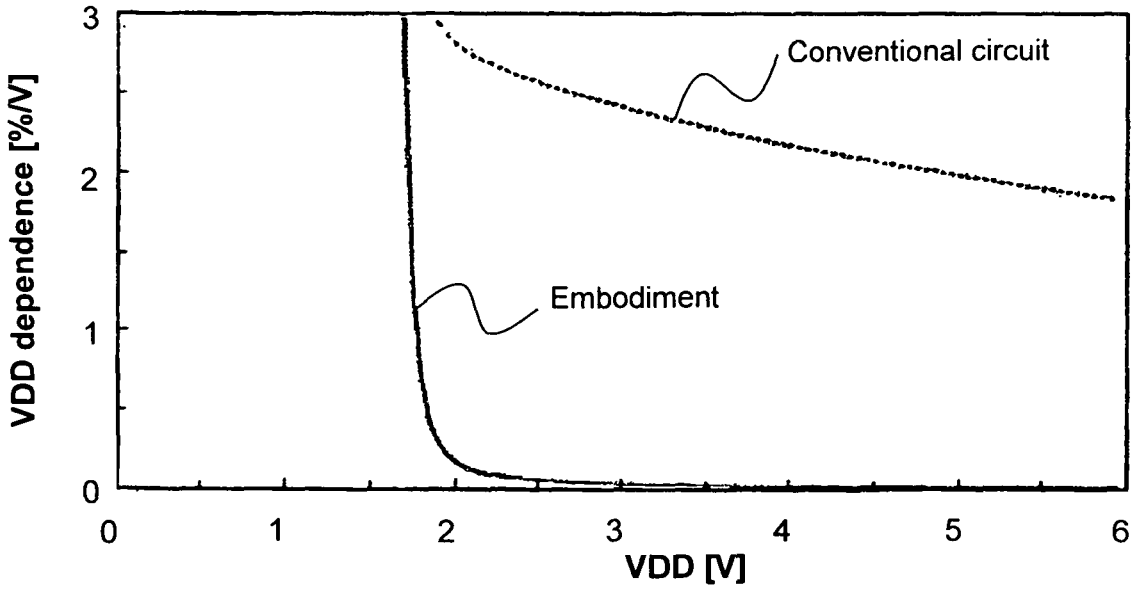
Figure 24:
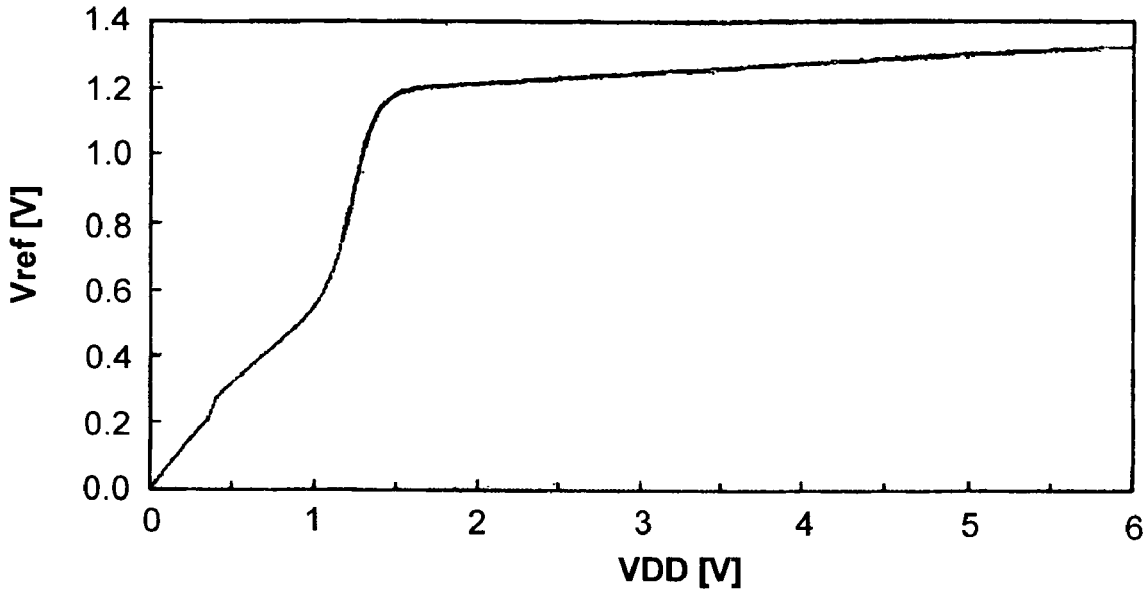
FIGS. 24(*a*) and 24(*b*) are graphs showing a property of the conventional reference voltage generation circuit, wherein FIG. 24(*a*) is a graph showing a relationship between an output voltage Vref and a power source voltage VDD, and FIG. 24(*b*) is a graph showing a relationship between a power source voltage dependence of the output voltage Vref and the power source voltage VDD.
Figure 24:
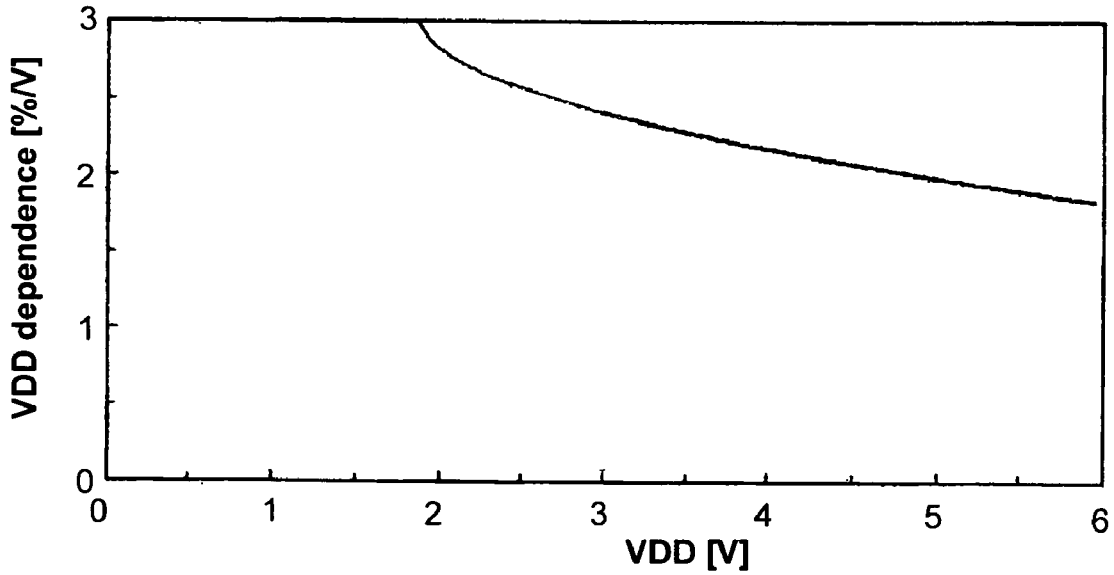
Figure 25:
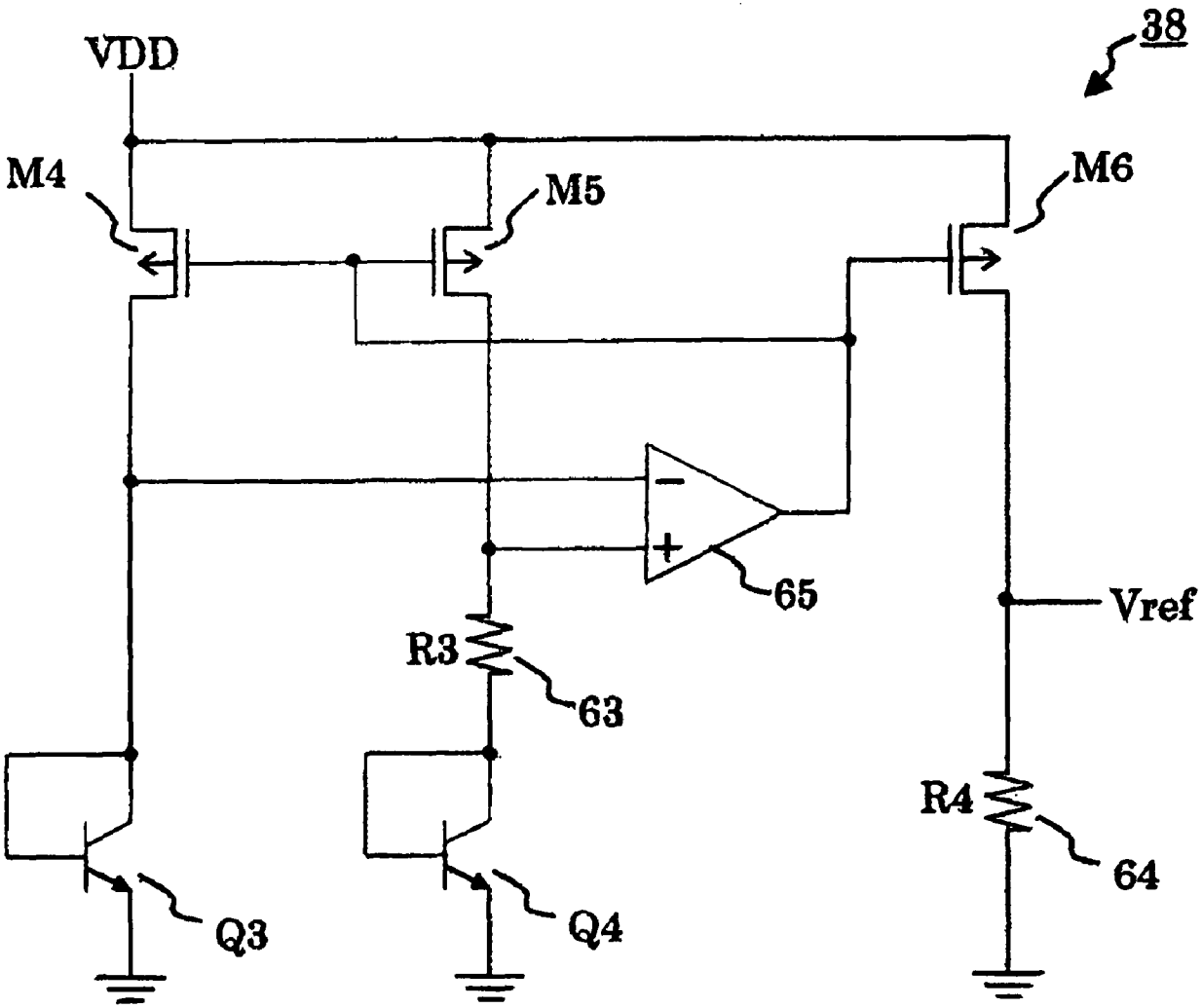
FIG. 25 is a circuit diagram showing another conventional reference voltage generation circuit.

FIGS. 11(*a*) and 11(*b*) are graphs showing a property of the reference voltage generation circuit 40 according to the second embodiment of the present invention. FIGS. 11(*a*) and 11(*b*) show a simulation result. A simulation result of a conventional circuit shown in FIG. 24 is indicated with a hidden line for comparison, and a simulation result of the reference voltage generation circuit 40 is indicated with a solid line.

FIG. 11(*a*) is a graph showing a relationship between the output voltage Vref and the power source voltage VDD. In FIG. 11(*a*), the horizontal axis represents the power source voltage VDD, and the vertical axis represents the output voltage Vref.

As shown in FIG. 11(*a*), the output voltage Vref is established when the power source voltage VDD becomes grater than 2 V (VDD>2 V). In the conventional circuit (hidden line), the output voltage Vref increases when the power source voltage VDD increases. In the reference voltage generation circuit 40 (solid line), the output voltage Vref is maintained constant when the power source voltage VDD increases.

FIG. 11(*b*) is a graph showing a relationship between a power source voltage dependence of the output voltage Vref and the power source voltage VDD. In FIG. 11(*b*), the power source voltage dependence of the output voltage Vref is defined by:

$$1/Vref\times(\Delta Vref/\Delta VDD)\times 100\ (\%/V)$$

As shown in FIG. 11(*b*), in the conventional circuit (hidden line), the output voltage Vref shows the power source voltage dependence of about 2.0%/° C. at the power source voltage VDD of 5 V. On the other hand, in the reference voltage generation circuit 40, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements.

As explained above, in the reference voltage generation circuit 39, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements. As a result, it is possible to perform the printing operation at a constant print density.

Third Embodiment

Figure 12:
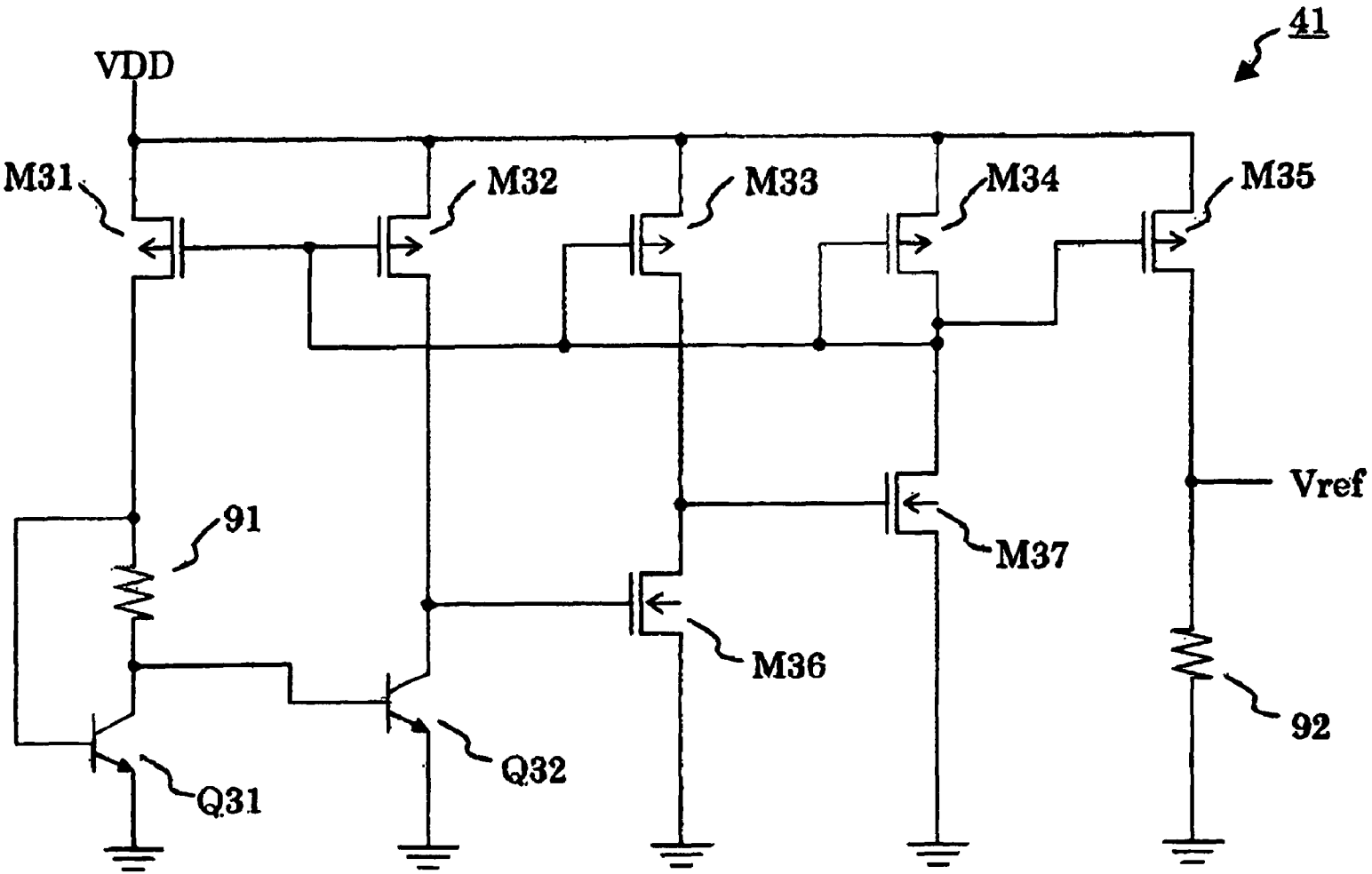
FIG. 12 is a circuit diagram showing a configuration of a reference voltage generation circuit according to a third embodiment of the present invention.

A third embodiment of the present invention will be explained next. FIG. 12 is a circuit diagram showing a configuration of a reference voltage generation circuit 41 according to the third embodiment of the present invention.

As shown in FIG. 12, the reference voltage generation circuit 41 includes PMOS transistor M31 to M35; NMOS transistors M36 and M37; NPN bipolar transistors Q31 and Q32; and resistors 91 and 92. The PMOS transistors M31 to M35 have source terminals connected to the power source VDD and gate terminals connected to each other and a drain terminal of the PMOS transistor M34.

In the embodiment, a drain terminal of the PMOS transistor M31 is connected to a base terminal of the bipolar transistor Q31 and one end portion of the resistor 91. The other end portion of the resistor 91 is connected to a collector terminal of the bipolar transistor Q31. A drain terminal of the PMOS transistor M32 is connected to a collector terminal of the bipolar transistor Q32. A base terminal of the bipolar transistor Q32 is connected to a collector terminal of the bipolar transistor Q31. A drain terminal of the PMOS transistor M33 is connected to a drain terminal of the NMOS transistor M36.

A gate terminal of the NMOS transistor M36 is connected to a collector terminal of the bipolar transistor Q32.

In the embodiment, a drain terminal of the PMOS transistor M34 is connected to a drain terminal of the NMOS transistor M37. A gate terminal of the NMOS transistor M37 is connected to a drain terminal of the NMOS transistor M36. A drain terminal of the PMOS transistor M35 is connected to one end portion of the resistor 92, and the other end portion of the resistor 92 is connected to ground. Emitter terminals of the bipolar transistors Q31 and Q32 are connected to ground. Source terminals of the NMOS transistors M36 and M37 are connected to ground.

In the embodiment, a drain terminal of the PMOS transistor M35 is connected to the output terminal Vref for applying the reference voltage Vref to the control voltage generation circuit 36 shown in FIG. 5. The NPN bipolar transistor Q32 has an emitter area N times larger than an emitter area of the NPN bipolar transistor Q31 (N>1).

Figure 13:
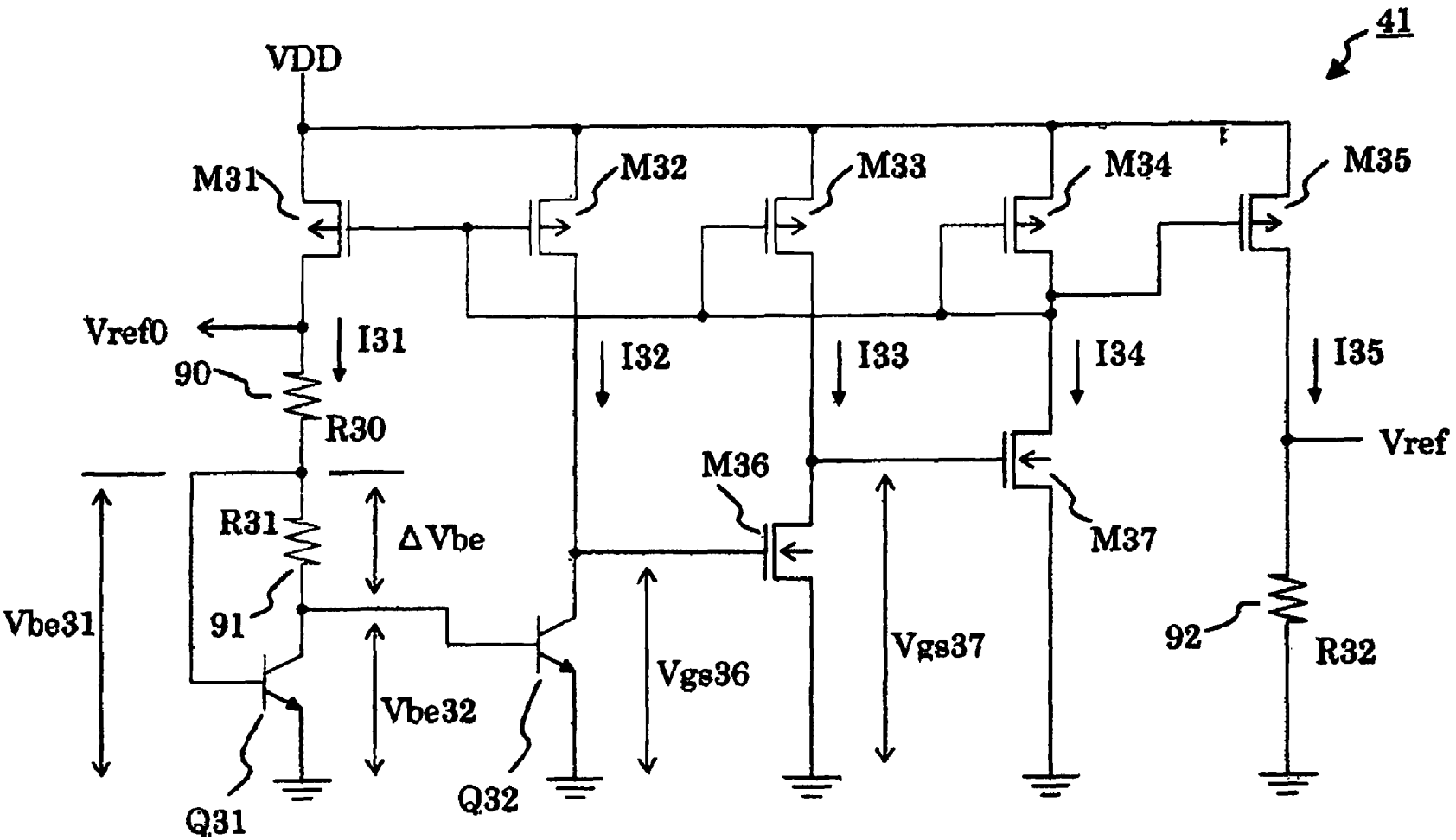
FIG. 13 is a circuit diagram showing an operation of the reference voltage generation circuit according to the third embodiment of the present invention.

An operation of the reference voltage generation circuit 41 will be explained next. FIG. 13 is a circuit diagram showing an operation of the reference voltage generation circuit 41 according to the third embodiment of the present invention. In FIG. 13, for the sake of the explanation, the resistors 91 and 92 have resistivities of R31 and R32. Further, a resistor 90 with resistivity of R30 is disposed between the resistor 91 and the drain terminal of the PMOS transistor M31.

The source terminals and the gate terminals of the PMOS transistor M31 to M35 are connected to with each other, and have a current-mirror relationship, in which a gate length and a gate width thereof are set to be identical. As a result, the PMOS transistors M31 to M35 shown in FIG. 13 have about the same drain currents I31 to I35.

In order to determine the output voltage Vref shown in FIG. 13, similar to the first and second embodiments, the drain current I31 of the PMOS transistor M31 is determined first. As well known in electric physics, an emitter current Ie and a base-emitter voltage Vbe of a bipolar transistor have the following relationship, $$Ie \approx Is \times \exp(qVbe/(kT))$$

where Is is a saturated current that is a constant determined to be proportional to an element area of a bipolar transistor, expo is an exponential function, q is a charge of electron, i.e., $q=1.6\times10^{-19}$ C, k is the Boltzmann constant, i.e., $k=1.38\times10^{-23}$ J/K, and T is an absolute temperature, i.e., T=298 K at a room temperature 23° C.

Through modifying the equation shown above, the following equation is obtained, $$Vbe=(kT/q)\times\ln(Ie/Is)$$

where in represents natural legalism.

It is supposed that the bipolar transistors Q31 and Q32 have base-emitter voltages of Vbe31 and Vbe32, emitter currents of Ie31 and Ie32, and saturated currents of Is31 and Is32. Accordingly, the following equations are established, $$Vbe31=(kT/q)\times\ln(Ie31/Is31)$$

$$Vbe32=(kT/q)\times\ln(Ie32/Is32)$$

As shown in FIG. 13, one end portion of the resistor 91 has a potential of Vbe31, and the other end portion of the resistor 91 has a potential of Vbe32. Accordingly, a potential difference ΔVbe applied to both end portions of the resistor 91 is given by, $$\Delta Vbe=Vbe31-Vbe32$$

When the equations are combined, the following equation is obtained, $$\Delta Vbe = (kT/q)\times[\ln(Ie31/Is31)-\ln(Ie32/Is32)]$$
$$= (kT/q)\times\ln[(Is32/Is31)\times\ln(Ie31/Ie32)]$$

As described above, a ratio of the emitter areas of the bipolar transistors Q21 and Q22 is 1 to N. Further, the saturated current is proportional to an element area of a transistor. Accordingly, the following relationship is established, $$Is32=Is31\times N$$

As described above, the PMOS transistors M31 to M35 have the current-mirror relationship, so that the drain currents I31 to I35 thereof are identical. Accordingly, the emitter currents Ie31 and Ie32 of the bipolar transistors Q31 and Q32 are identical, and the following equation is established, $$\Delta Vbe=(kT/q)\times\ln(N)$$

Further, the drain current I31 of the PMOS transistor M31 is equal to a current flowing through the resistor 91. Accordingly, the following equation is established, $$I31=\Delta Vbe/R31=(1/R31)\times(kT/q)\times\ln(N)$$

In the embodiment, the collector terminal of the bipolar transistor Q32 is connected to the gate terminal of the NMOS transistor M36, and the collector terminal of the bipolar transistor Q32 has a potential the same as a gate-source voltage Vgs23 of the NMOS transistor M36. The drain terminal of the NMOS transistor M36 is connected to the gate terminal of the NMOS transistor M37, and the drain terminal of the NMOS transistor M36 has a potential the same as a gate-source voltage Vgs37 of the NMOS transistor M37. The drain terminal of the NMOS transistor M37 is connected to the gate terminal of the PMOS transistor M34.

When the power source voltage VDD increases, the gate potentials of the PMOS transistors M31 to M35 increase to maintain the drain current I31 of the PMOS transistor M31. The collector potentials of the bipolar transistors Q32 and Q33 are maintained at levels of the gate-source voltage Vgs36 of the NMOS transistor M36, and do not fluctuate to a large extent. Accordingly, even when the bipolar transistor Q32 has a low early voltage, the collector potential thereof is maintained at the gate-source voltage Vgs36, thereby minimizing a variance in the collector current of the bipolar transistor Q32.

When the power source voltage VDD increases, or the drain current I31 of the PMOS transistor M31 increases slightly due to an influence of an external noise, the base-emitter voltage Vbe31 of the bipolar transistor Q31 increases slightly and the collector current of the bipolar transistor Q31 increases. Accordingly, the voltage decrease at the resistor 91 increases, and the collector potential of the bipolar transistor Q31 decreases. At this time, the collector potential of the bipolar transistor Q31 is equal to the base-emitter voltage Vbe32 of the bipolar transistor Q32. Accordingly, the collector potential of the bipolar transistor Q32 increases slightly.

Further, the collector potential of the bipolar transistor Q32 is equal to the gate-source voltage Vgs36 of the NMOS transistor M36. Accordingly, the gate potential of the NMOS transistor M36 decreases slightly. Still further, the drain potential of the NMOS transistor M36 is equal to the gate-source voltage Vgs37 of the NMOS transistor M37. Accordingly, the drain potential of the NMOS transistor M37 increases slightly.

As described above, the drain terminal of the NMOS transistor M37 is connected to the gate terminals of the PMOS transistors M31 to M35. Accordingly, when the drain potential of the NMOS transistor M37 increases, gate-source voltages of the PMOS transistors M31 to M35 decrease. As a result, there occurs a feedback of reducing the drain current I31 of the PMOS transistor M31, thereby canceling the slight increase in the drain current I31 of the PMOS transistor M31, i.e., a starting point of the feedback.

In the embodiment, the drain current I31 of the PMOS transistor M31 is equal to the drain current I35 of the PMOS transistor M35 (I31=I35). As described above, the drain current I31 of the PMOS transistor M31 is given by, $$I31=\Delta Vbe/R31=(1/R31)\times(kT/q)\times\ln(N)$$

At this time, the output voltage Vref is equal to a product of the drain current I35 and the resistivity R32 (Vref=I35×R32). Accordingly, the output voltage Vref of the reference voltage generation circuit 41 is given by, $$Vref=(R32/R31)\times(kT/q)\times\ln(N)$$

According to the above equation, the output voltage Vref is proportional to the absolute temperature T, and the temperature coefficient at a room temperature becomes about +0.33%/V.

Figure 14:
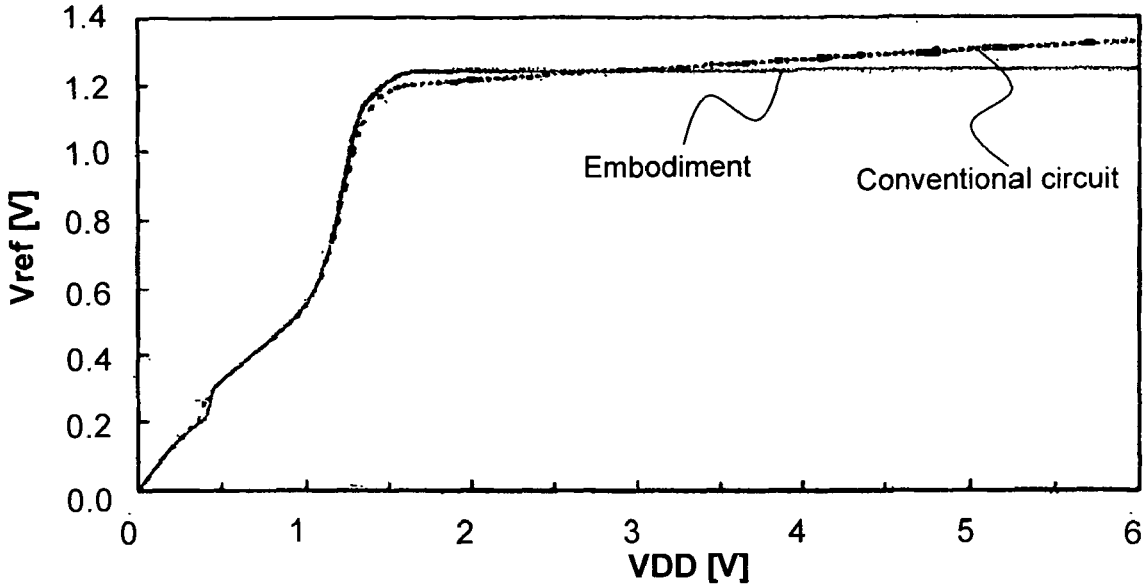
FIGS. 14(*a*) and 14(*b*) are graphs showing a property of the reference voltage generation circuit according to the third embodiment of the present invention, wherein FIG. 14(*a*) is a graph showing a relationship between the output voltage Vref and the power source voltage VDD, and FIG. 14(*b*) is a graph showing a relationship between a power source voltage dependence of the output voltage Vref and the power source voltage VDD.
Figure 14:
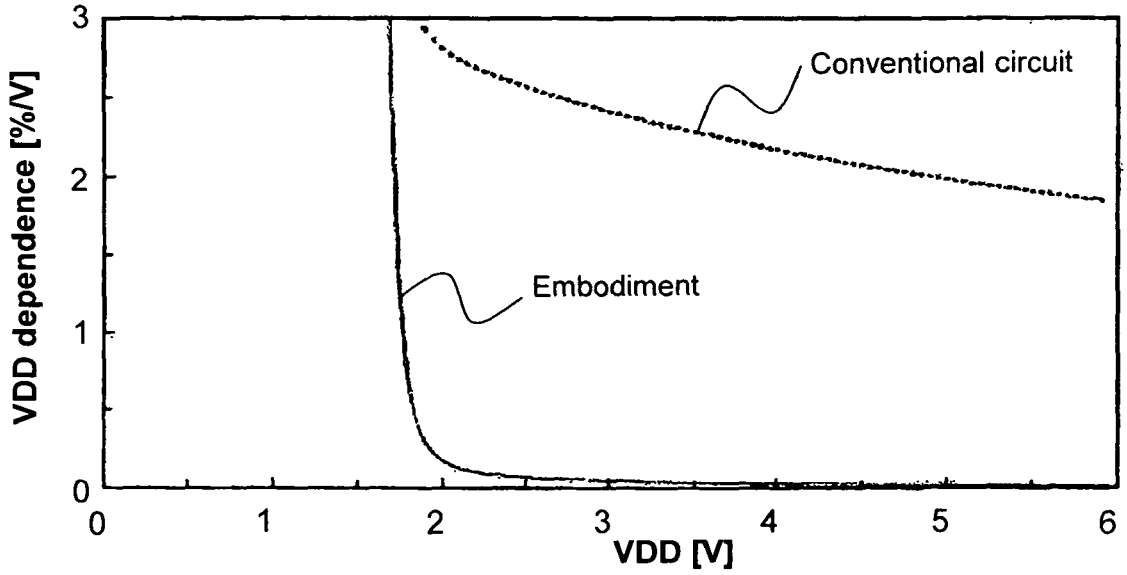

FIGS. 14(*a*) and 14(*b*) are graphs showing a property of the reference voltage generation circuit 41 according to the third embodiment of the present invention. FIGS. 14(*a*) and 14(*b*) show a simulation result. A simulation result of a conventional circuit shown in FIG. 24 is indicated with a hidden line for comparison, and a simulation result of the reference voltage generation circuit 41 is indicated with a solid line.

FIG. 14(*a*) is a graph showing a relationship between the output voltage Vref and the power source voltage VDD. In FIG. 14(*a*), the horizontal axis represents the power source voltage VDD, and the vertical axis represents the output voltage Vref.

As shown in FIG. 14(*a*), the output voltage Vref is established when the power source voltage VDD becomes grater than 2 V (VDD>2 V). In the conventional circuit (hidden line), the output voltage Vref increases when the power source voltage VDD increases. In the reference voltage generation circuit 41 (solid line), the output voltage Vref is maintained constant when the power source voltage VDD increases.

FIG. 14(*b*) is a graph showing a relationship between a power source voltage dependence of the output voltage Vref and the power source voltage VDD. In FIG. 14(*b*), the power source voltage dependence of the output voltage Vref is defined by:

$$1/Vref\times(\Delta Vref/\Delta VDD)\times100\ (\%/V)$$

As shown in FIG. 14(*b*), in the conventional circuit (hidden line), the output voltage Vref shows the power source voltage dependence of about 2.0%/° C. at the power source voltage VDD of 5 V. On the other hand, in the reference voltage generation circuit 41, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements.

As explained above, in the reference voltage generation circuit 41, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements. As a result, it is possible to perform the printing operation at a constant print density.

Fourth Embodiment

Figure 15:
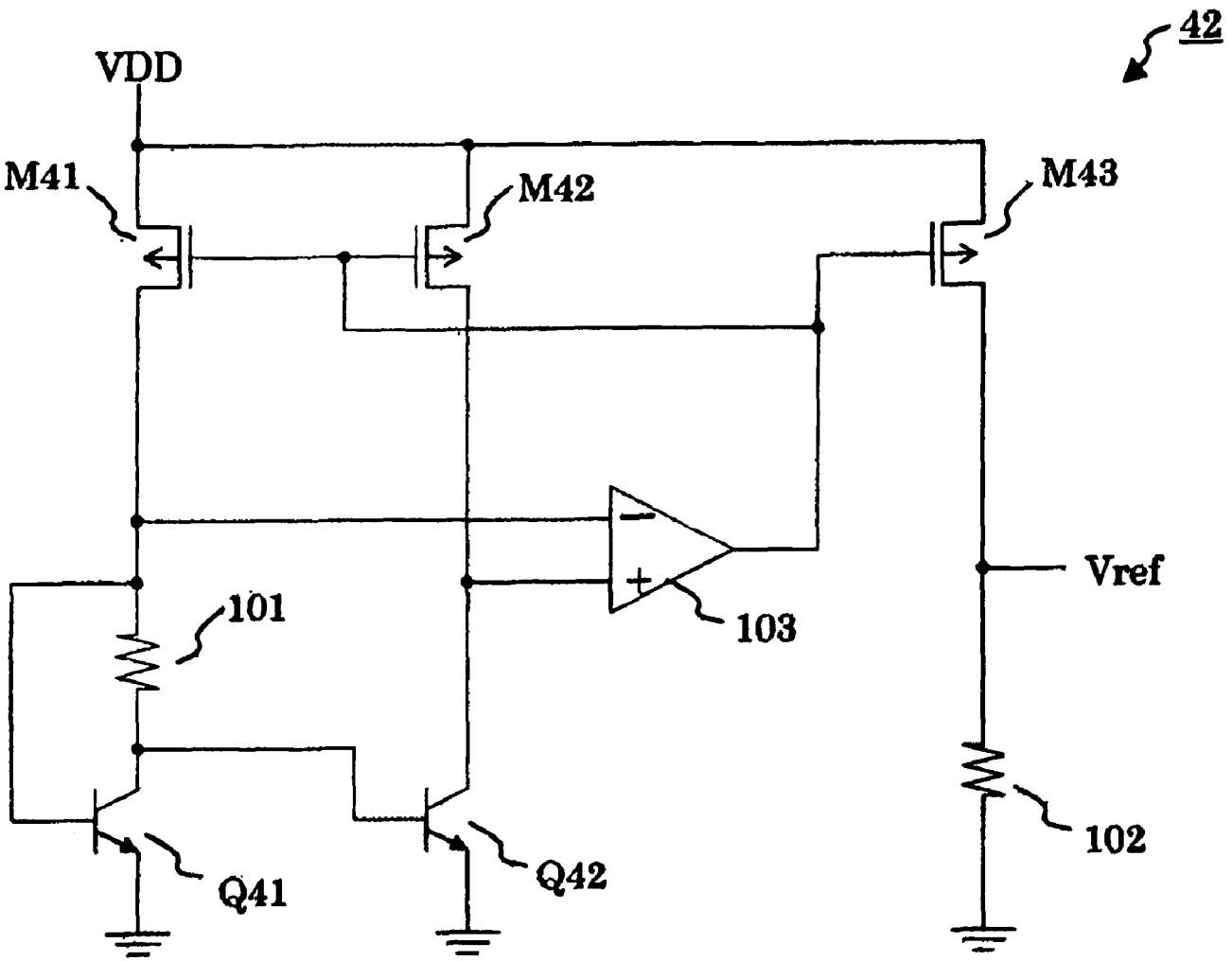
FIG. 15 is a circuit diagram showing a configuration of a reference voltage generation circuit according to a fourth embodiment of the present invention.

A fourth embodiment of the present invention will be explained next. FIG. 15 is a circuit diagram showing a configuration of a reference voltage generation circuit 42 according to a fourth embodiment of the present invention.

As shown in FIG. 15, the AND circuit 42 includes PMOS transistor M41 to M43; NPN bipolar transistors Q41 and Q42; resistors 101 and 102; and a operational amplifier 103. The PMOS transistors M41 to M43 have source terminals connected to the power source VDD and gate terminals connected to each other and an output terminal of the operational amplifier 103.

In the embodiment, a drain terminal of the PMOS transistor M41 is connected to a base terminal of the bipolar transistor Q41 and one end portion of the resistor 101. The other end portion of the resistor 101 is connected to a collector terminal of the bipolar transistor Q41. A drain terminal of the PMOS transistor M42 is connected to a collector terminal of the bipolar transistor Q42. A base terminal of the bipolar transistor Q42 is connected to a collector terminal of the bipolar transistor Q41. Emitter terminals of the bipolar transistors Q41 and Q42 are connected to ground.

In the embodiment, a drain terminal of the PMOS transistor M43 is connected to one end portion of the resistor 102 and the output terminal Vref for applying the reference voltage Vref to the control voltage generation circuit 36 shown in FIG. 5. The other end portion of the resistor 102 is connected to ground. The NPN bipolar transistor Q42 has an emitter area N times larger than an emitter area of the NPN bipolar transistor Q41 (N>1).

In the embodiment, a reverse input terminal of the operational amplifier 103 is connected to a base terminal of the bipolar transistor Q41, and a non-reverse input terminal of the operational amplifier 103 is connected to a collector terminal of the bipolar transistor Q42. The output terminal of the operational amplifier 103 is connected to gate terminals of the PMOS transistors M41 to M43.

Figure 16:
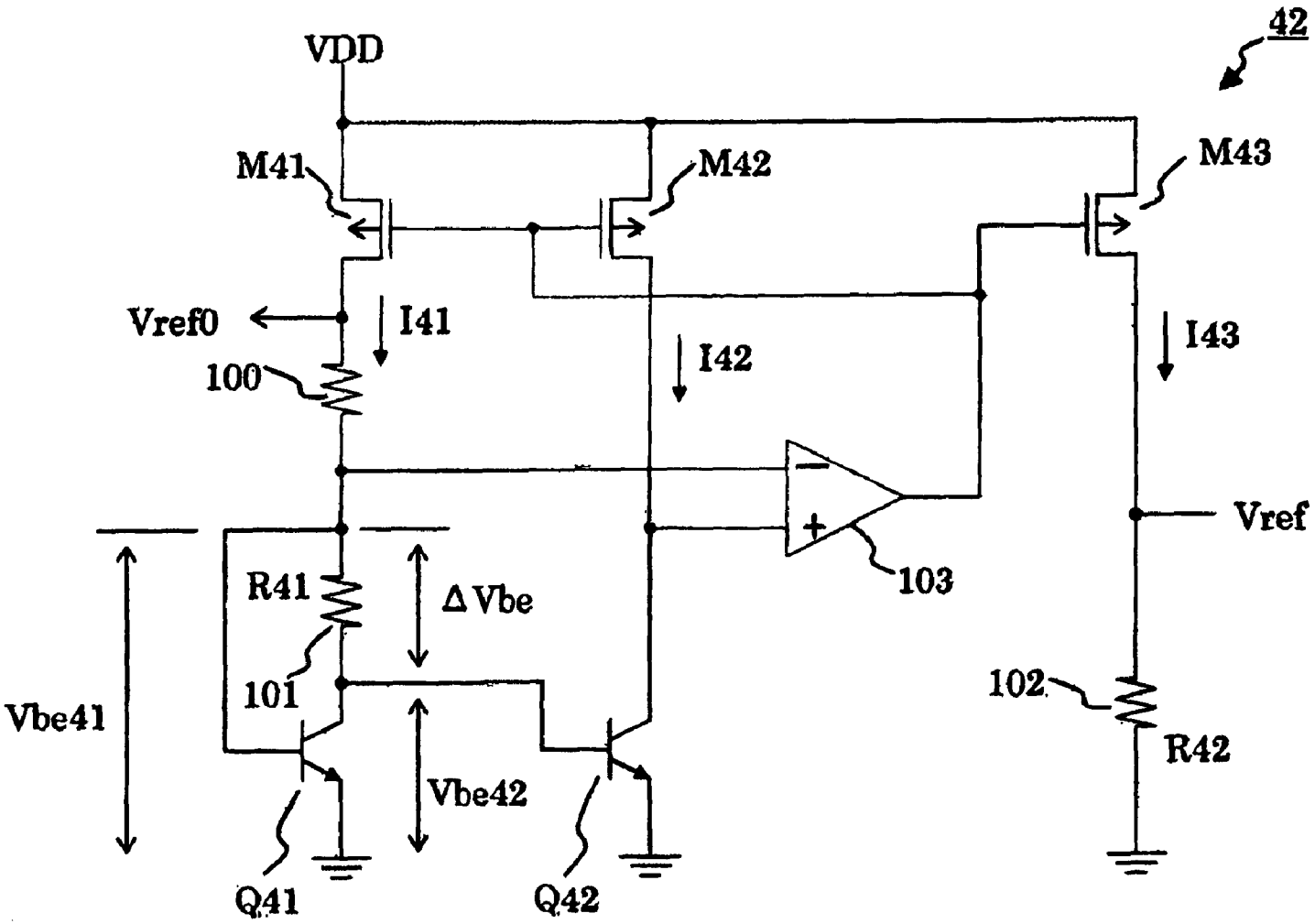
FIG. 16 is a circuit diagram showing an operation of the reference voltage generation circuit according to the fourth embodiment of the present invention.

An operation of the reference voltage generation circuit 42 will be explained next. FIG. 16 is a circuit diagram showing an operation of the reference voltage generation circuit 42 according to the fourth embodiment of the present invention. In FIG. 16, for the sake of the explanation, the resistors 101 and 102 have resistivities of R41 and R42. Further, a resistor 100 is disposed between the resistor 101 and the drain terminal of the PMOS transistor M41.

The source terminals and the gate terminals of the PMOS transistor M41 to M43 are connected to with each other, and have a current-mirror relationship, in which a gate length and a gate width thereof are set to be identical. As a result, the PMOS transistors M41 to M43 shown in FIG. 16 have about the same drain currents I41 to I43.

In order to determine the output voltage Vref shown in FIG. 16, similar to the first to third embodiments, the drain current I41 of the PMOS transistor M41 is determined first. As well known in electric physics, an emitter current Ie and a base-emitter voltage Vbe of a bipolar transistor have the following relationship, $$Ie\approx Is\times\exp(qVbe/(kT))$$

where Is is a saturated current that is a constant determined to be proportional to an element area of a bipolar transistor, exp() is an exponential function, q is a charge of electron, i.e., $q=1.6\times10^{-19}$ C, k is the Boltzmann constant, i.e., $k=1.38\times10^{-23}$ J/K, and T is an absolute temperature, i.e., T=298 K at a room temperature 23° C.

Through modifying the equation shown above, the following equation is obtained, $$Vbe=(kT/q)\times\ln(Ie/Is)$$

where ln represents natural legalism.

It is supposed that the bipolar transistors Q41 and Q42 have base-emitter voltages of Vbe41 and Vbe42, emitter currents of Ie41 and Ie42, and saturated currents of Is41 and Is42. Accordingly, the following equations are established, $$Vbe41=(kT/q)\times\ln(Ie41/Is41)$$

$$Vbe42=(kT/q)\times\ln(Ie42/Is42)$$

As shown in FIG. 16, one end portion of the resistor 101 has a potential of Vbe41, and the other end portion of the resistor 101 has a potential of Vbe42. Accordingly, a potential difference ΔVbe applied to both end portions of the resistor 101 is given by, $$\Delta Vbe=Vbe41-Vbe42$$

When the equations are combined, the following equation is obtained, $$\Delta Vbe=(kT/q)\times[\ln(Ie41/Is41)-\ln(Ie42/Is42)]$$
$$=(kT/q)\times\ln[(Is42/Is41)\times\ln(Ie41/Ie42)]$$

As described above, a ratio of the emitter areas of the bipolar transistors Q41 and Q42 is 1 to N. Further, the saturated current is proportional to an element area of a transistor. Accordingly, the following relationship is established, $$Is42=Is41\times N$$

As described above, the PMOS transistors M41 to M43 have the current-mirror relationship, so that the drain currents I41 to I43 thereof are identical. Accordingly, the emitter currents Ie41 and Ie42 of the bipolar transistors Q41 and Q42 are identical, and the following equation is established, $$\Delta Vbe=(kT/q)\times\ln(N)$$

Further, the drain current I41 of the PMOS transistor M41 is equal to a current flowing through the resistor 101. Accordingly, the following equation is established, $$I41=\Delta Vbe/R41=(1/R41)\times(kT/q)\times\ln(N)$$

In the embodiment, the collector terminal of the bipolar transistor Q42 is connected to the non-reverse input terminal of the operational amplifier 103. Accordingly, an output potential of the operational amplifier 103 is controlled such that the collector terminal of the bipolar transistor Q42 has a potential the same as that of the reverse input terminal of the operational amplifier 103, i.e., a base potential of the bipolar transistor Q41. Accordingly, even when the bipolar transistor Q42 has a low early voltage, the collector potential thereof is maintained at the base potential Vbe41 of the bipolar transistor 41, thereby minimizing a variance in the collector current of the bipolar transistor Q42.

When the power source voltage VDD increases, or the drain current I41 of the PMOS transistor M41 increases slightly due to an influence of an external noise, the base-emitter voltage Vbe41 of the bipolar transistor Q41 increases slightly and the collector current of the bipolar transistor Q41 increases. Accordingly, the voltage decrease at the resistor 101 increases, and the collector potential of the bipolar transistor Q41 decreases. At this time, the collector potential of the bipolar transistor Q41 is equal to the base-emitter voltage Vbe42 of the bipolar transistor Q42. Accordingly, the collector potential of the bipolar transistor Q42 increases slightly.

An increase in the collector potential of the bipolar transistor Q42 is transmitted to the non-reverse input terminal of the operational amplifier 103, thereby increasing an output potential of the operational amplifier 103. As described above, the output terminal of the operational amplifier 103 is connected to the gate terminals of the PMOS transistors M41 to M43. Accordingly, gate-source voltages of the PMOS transistors M41 to M43 decrease. As a result, there occurs a feedback of reducing the drain current I41 of the PMOS transistor M41, thereby canceling the slight increase in the drain current I41 of the PMOS transistor M41, i.e., a starting point of the feedback.

In the embodiment, the drain current I41 of the PMOS transistor M41 is equal to the drain current I43 of the PMOS transistor M43 (I41 =I43). As described above, the drain current I41 of the PMOS transistor M41 is given by, $$I41=\Delta Vbe/R41=(1/R41)\times(kT/q)\times\ln(N)$$

At this time, the output voltage Vref is equal to a product of the drain current I43 and the resistivity R42 (Vref=I43×R42). Accordingly, the output voltage Vref of the AND circuit 42 is given by, $$Vref=(R42/R41)\times(kT/q)\times\ln(N)$$

According to the above equation, the output voltage Vref is proportional to the absolute temperature T, and the temperature coefficient at a room temperature becomes about +0.33%/V.

Figure 17:
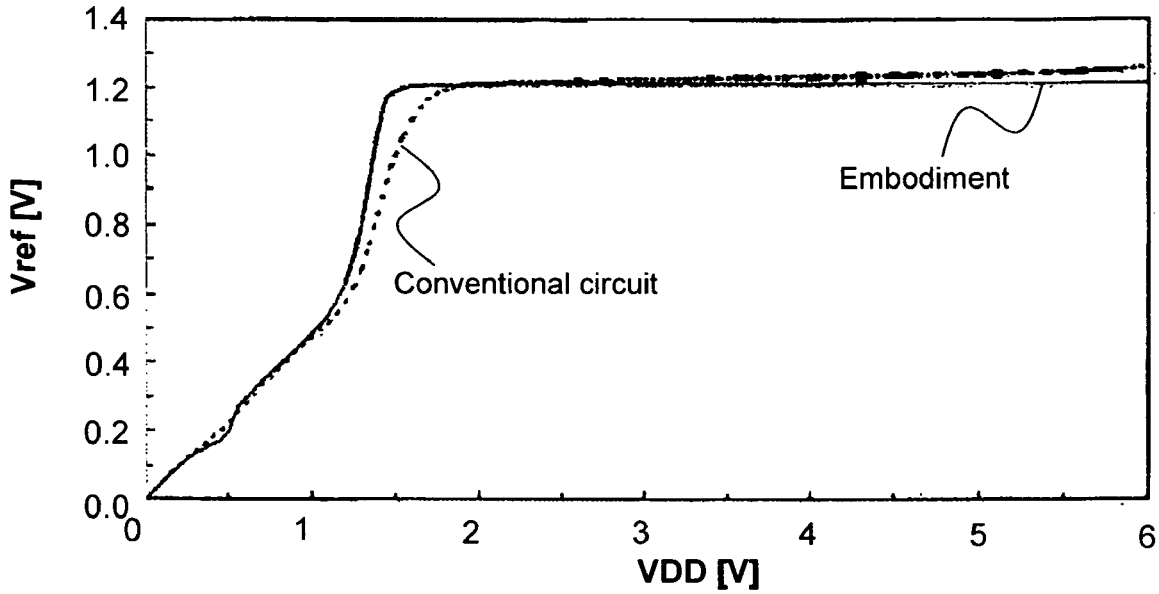
FIGS. 17(*a*) and 17(*b*) are graphs showing a property of the reference voltage generation circuit according to the fourth embodiment of the present invention, wherein FIG. 17(*a*) is a graph showing a relationship between the output voltage Vref and the power source voltage VDD, and FIG. 17(*b*) is a graph showing a relationship between a power source voltage dependence of the output voltage Vref and the power source voltage VDD.
Figure 17:
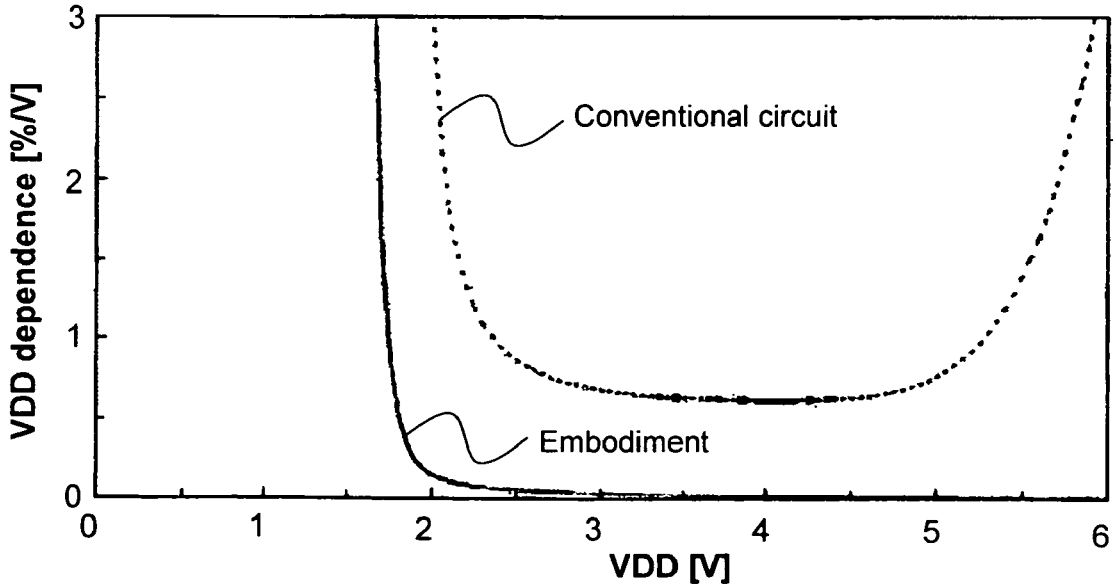
Figure 26:
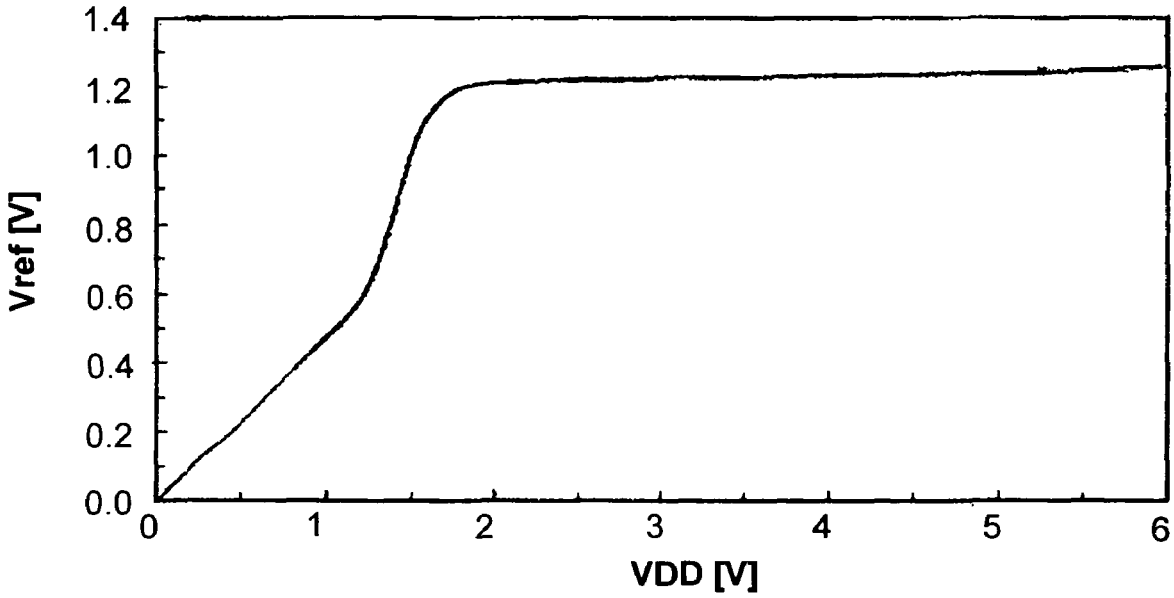
FIGS. 26(*a*) and 26(*b*) are graphs showing a property of another conventional reference voltage generation circuit, wherein FIG. 26(*a*) is a graph showing a relationship between an output voltage Vref and a power source voltage VDD, and FIG. 26(*b*) is a graph showing a relationship between a power source voltage dependence of the output voltage Vref and the power source voltage VDD.
Figure 26:
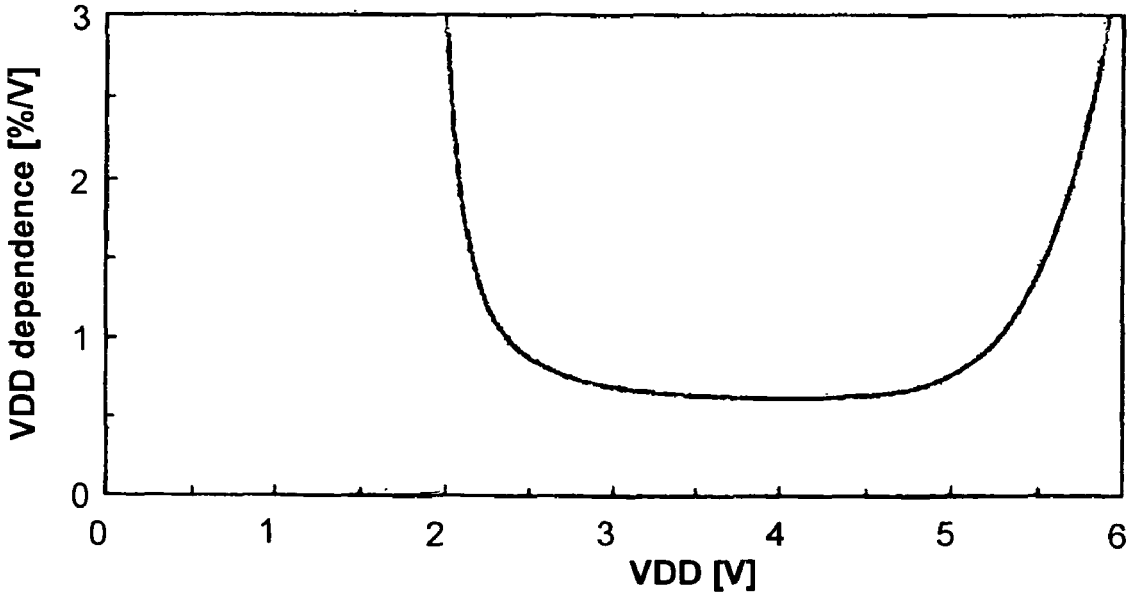

FIGS. 17(*a*) and 17(*b*) are graphs showing a property of the reference voltage generation circuit 42 according to the fourth embodiment of the present invention. FIGS. 17(*a*) and 17(*b*) show a simulation result. A simulation result of a conventional circuit shown in FIG. 26 is indicated with a hidden line for comparison, and a simulation result of the reference voltage generation circuit 42 is indicated with a solid line.

FIG. 17(*a*) is a graph showing a relationship between the output voltage Vref and the power source voltage VDD. In FIG. 17(*a*), the horizontal axis represents the power source voltage VDD, and the vertical axis represents the output voltage Vref.

As shown in FIG. 17(*a*), the output voltage Vref is established when the power source voltage VDD becomes grater than 2 V (VDD>2 V). In the conventional circuit (hidden line), the output voltage Vref increases when the power source voltage VDD increases. In the reference voltage generation circuit 42 (solid line), the output voltage Vref is maintained constant when the power source voltage VDD increases.

FIG. 17(*b*) is a graph showing a relationship between a power source voltage dependence of the output voltage Vref and the power source voltage VDD. In FIG. 17(*b*), the power source voltage dependence of the output voltage Vref is defined by:

$$1/Vref\times(\Delta Vref/\Delta VDD)\times100\ (\%/V)$$

As shown in FIG. 14(*b*), in the conventional circuit shown in FIG. 26 (hidden line), the output voltage Vref shows the power source voltage dependence of about 0.8%/° C. at the power source voltage VDD of 5 V. On the other hand, in the AND circuit 42, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements.

Figure 18:
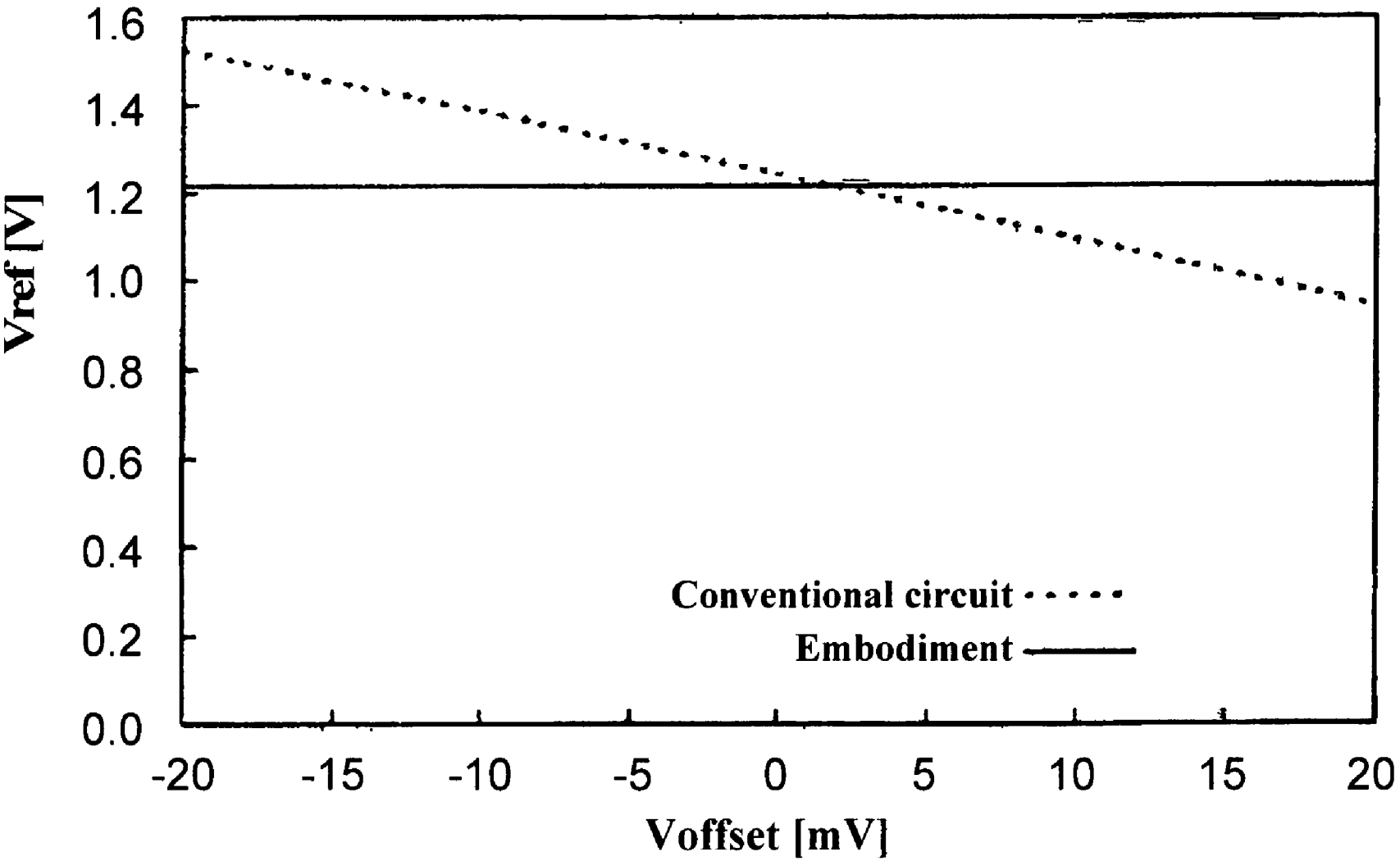
FIG. 18 is a graph showing a simulation of the property of the reference voltage generation circuit according to the fourth embodiment of the present invention.
Figure 27:
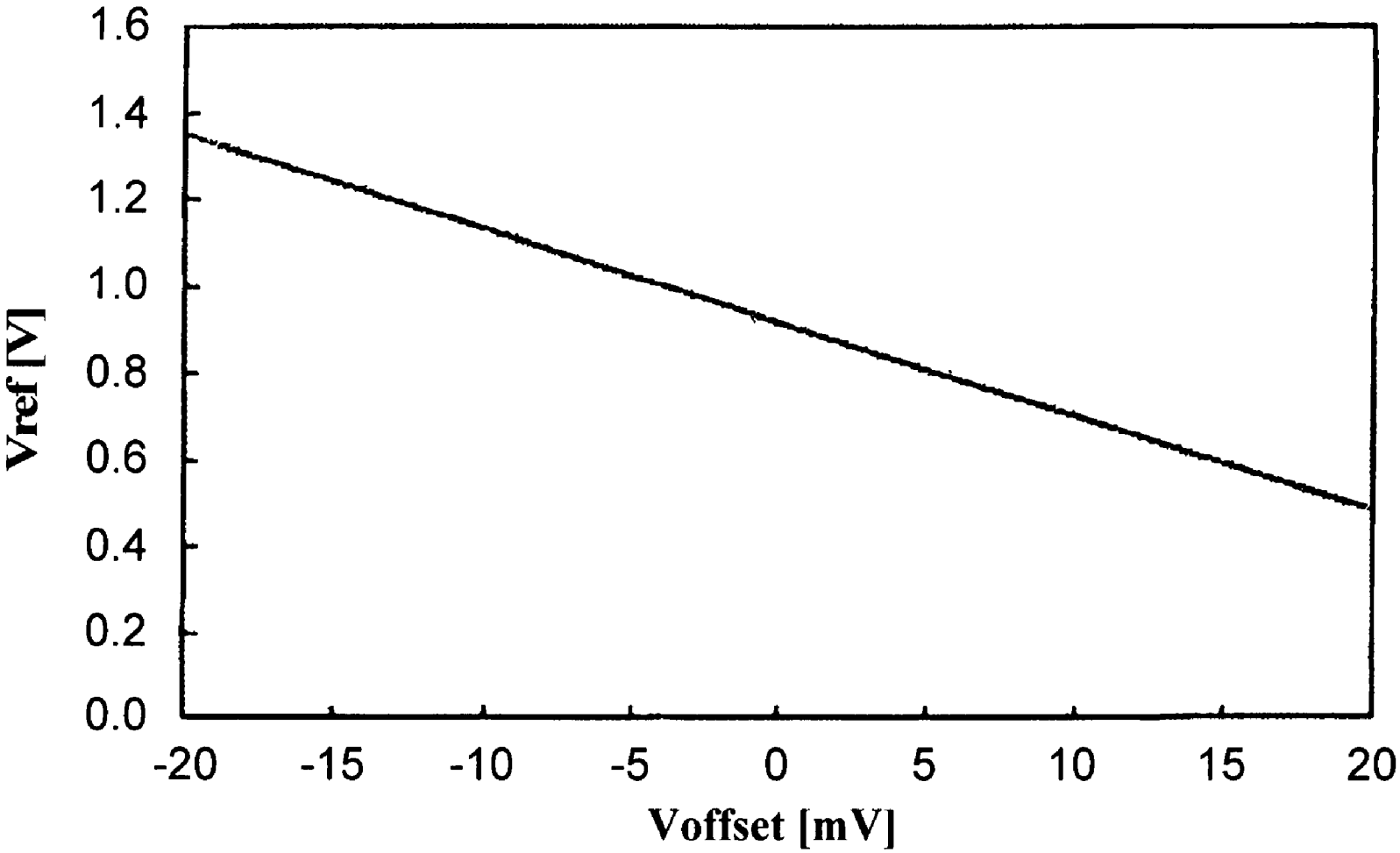
FIG. 27 is a graph showing a relationship between the output voltage Vref and an offset voltage in another conventional reference voltage generation circuit.

FIG. 18 is a graph showing a simulation of the property of the reference voltage generation circuit 42 according to the fourth embodiment of the present invention. In FIG. 18, the horizontal axis represents an offset voltage of the operational amplifier, and the vertical axis represents the output voltage Vref. Further, in FIG. 18, a simulation result of a conventional circuit shown in FIG. 27 is indicated with a hidden line for comparison, and a simulation result of the reference voltage generation circuit 42 is indicated with a solid line.

As shown in FIG. 18, in the conventional circuit, when the offset voltage is merely a few mV, the output voltage Vref changes significantly. Accordingly, it is necessary to eliminate even a small variance in the production process. On the other hand, in the reference voltage generation circuit 42, when the offset voltage varies, the output voltage Vref does not change significantly. Accordingly, it is not necessary to eliminate a small variance in the production process. As a result, a change in the offset voltage does not have a significant influence on a production yield of the driver IC, thereby preventing the yield from decreasing, and decreasing a production cost of the LED head and the printer.

As described above, in the AND circuit 42, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements. As a result, it is possible to perform the printing operation at a constant print density.

Further, in the conventional circuit using a operational amplifier, when the offset voltage changes, the reference voltage changes significantly. Accordingly, it is necessary to eliminate even a small variance in the production process, thereby deteriorating the production yield, and increasing the production cost. On the other hand, in the embodiment, even when the operational amplifier 103 causes a small offset voltage, the output voltage Vref does not change significantly. Accordingly, it is possible to improve the production yield, thereby decreasing the production cost.

Fifth Embodiment

Figure 19:
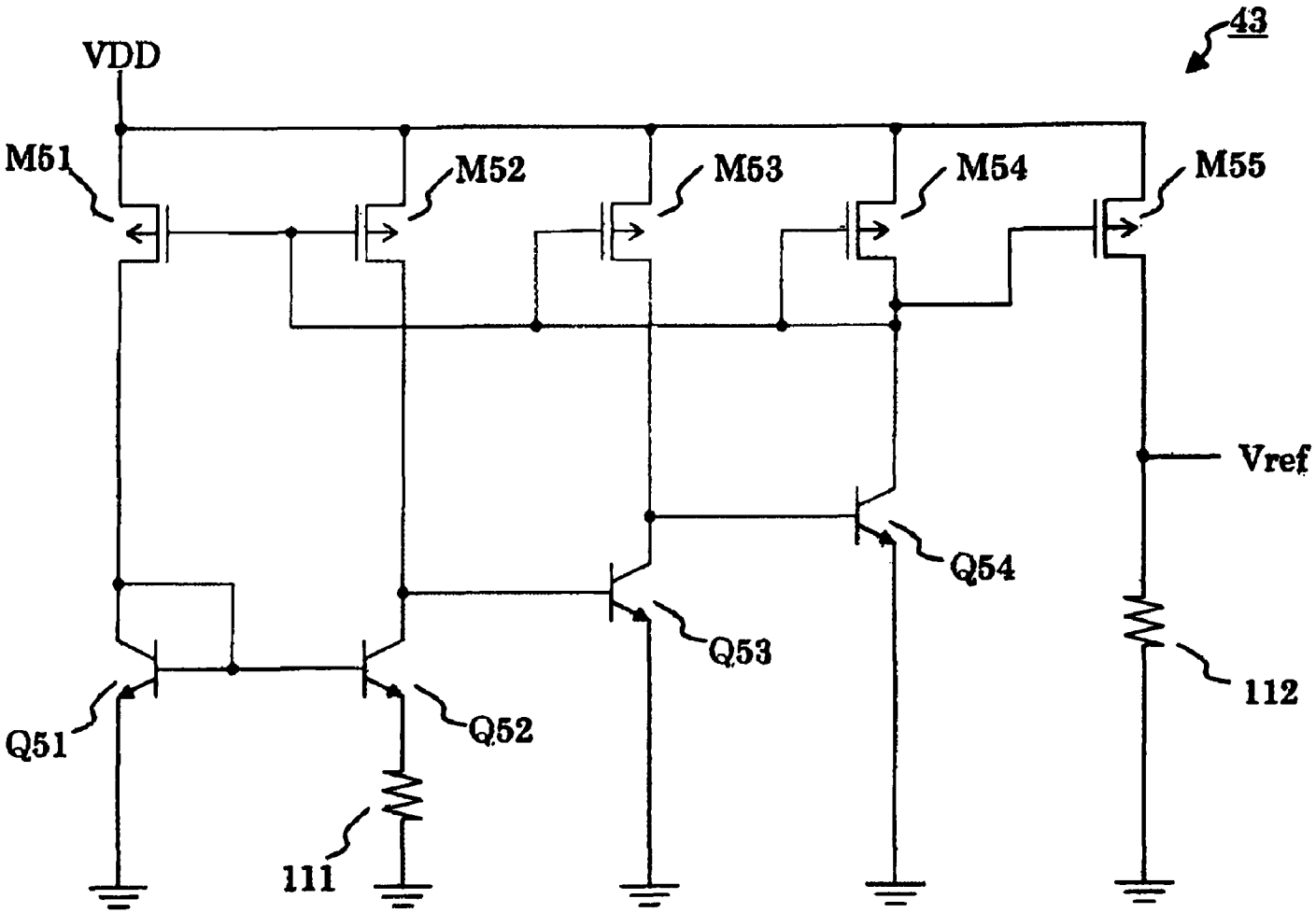
FIG. 19 is a circuit diagram showing a configuration of a reference voltage generation circuit according to a fifth embodiment of the present invention.

A fifth embodiment of the present invention will be explained next. FIG. 19 is a circuit diagram showing a configuration of a reference voltage generation circuit 43 according to the fifth embodiment of the present invention.

As shown in FIG. 19, the PMOS transistor 43 includes PMOS transistor M51 to M55; NPN bipolar transistors Q51 to Q54; and resistors 112 and 112. The PMOS transistors M51 to M55 have source terminals connected to the power source VDD and gate terminals connected to each other and a drain terminal of the PMOS transistor M54.

In the embodiment, a drain terminal of the PMOS transistor M51 is connected to a base terminal and a collector terminal of the bipolar transistor Q51 and a base terminal of the bipolar transistor Q52. A drain terminal of the PMOS transistor M52 is connected to a collector terminal of the bipolar transistor Q52 and a base terminal of the bipolar transistor Q53. A drain terminal of the PMOS transistor M53 is connected to a collector terminal of the bipolar transistor Q53 and a base terminal of the bipolar transistor Q54. A drain terminal of the PMOS transistor M54 is connected to a collector terminal of the bipolar transistor Q54.

In the embodiment, a drain terminal of the PMOS transistor M55 is connected to one end portion of the resistor 112. The other end portion of the resistor 112 is connected to ground. A drain terminal of the PMOS transistor M55 is connected to the output terminal Vref for applying the reference voltage Vref to the control voltage generation circuit 36 shown in FIG. 5.

In the embodiment, emitter terminals of the bipolar transistors Q51, Q53, and Q54 are connected to ground. An emitter terminal of the bipolar transistor Q52 is connected to ground through the resistor 111. The bipolar transistor Q52 has an emitter area N times larger than an emitter area of the NPN bipolar transistor Q51 (N>1). It is possible to set an arbitrary emitter area for the NPN bipolar transistors Q53 and Q54. It is preferable to set the emitter area for the NPN bipolar transistors Q53 and Q54 substantially the same as that of the bipolar transistor Q51.

Figure 20:
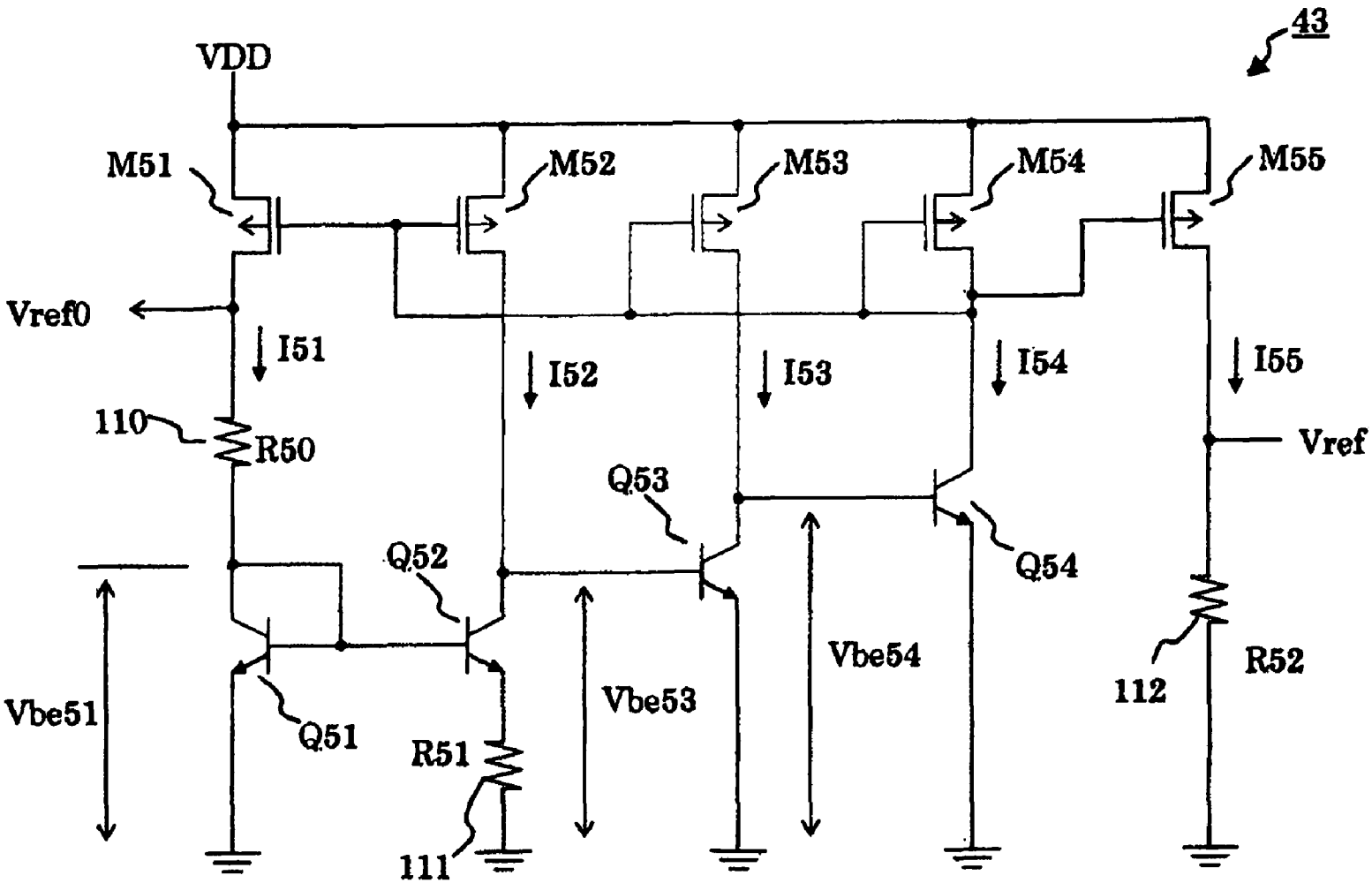
FIG. 20 is a circuit diagram showing an operation of the reference voltage generation circuit according to the fifth embodiment of the present invention.

An operation of the reference voltage generation circuit 43 will be explained next. FIG. 20 is a circuit diagram showing an operation of the reference voltage generation circuit 43 according to the fifth embodiment of the present invention. In FIG. 20, for the sake of the explanation, the resistors 111 and 112 have resistivities of R51 and R52. Further, a resistor 110 with resistivity of R50 is disposed between the drain terminal of the PMOS transistor M51 and the collector terminal of the bipolar transistor Q51.

The source terminals and the gate terminals of the PMOS transistor M51 to M55 are connected to with each other, and have a current-mirror relationship, in which a gate length and a gate width thereof are set to be identical. As a result, the PMOS transistors M51 to M55 shown in FIG. 20 have about the same drain currents I51 to I55.

In order to determine the output voltage Vref shown in FIG. 20, similar to the first and second embodiments, the drain current I51 of the PMOS transistor M51 is determined first. As well known in electric physics, an emitter current Ie and a base-emitter voltage Vbe of a bipolar transistor have the following relationship, $$Ie \approx Is \times \exp(qVbe/(kT))$$

where Is is a saturated current that is a constant determined to be proportional to an element area of a bipolar transistor, exp() is an exponential function, q is a charge of electron, i.e., $q=1.6\times10^{-19}$ C, k is the Boltzmann constant, i.e., $k=1.38\times10^{-23}$ J/K, and T is an absolute temperature, i.e., T=298 K at a room temperature 23° C.

Through modifying the equation shown above, the following equation is obtained, $$Vbe=(kT/q)\times\ln(Ie/Is)$$

where ln represents natural legalism.

It is supposed that the bipolar transistors Q51 and Q52 have base-emitter voltages of Vbe51 and Vbe52, emitter currents of Ie51 and Ie52, and saturated currents of Is51 and Is52. Accordingly, the following equations are established, $$Vbe51=(kT/q)\times\ln(Ie51/Is51)$$

$$Vbe52=(kT/q)\times\ln(Ie52/Is52)$$

As shown in FIG. 20, the collector terminal of the bipolar transistor Q51 has a potential Vbe51 the same as that of the base terminal of the bipolar transistor Q51, and the collector terminal of the bipolar transistor Q52 has a potential Vbe53 the same as that of the base terminal of the bipolar transistor Q53. The drain current I51 of the PMOS transistor M51 is equal to the drain current I53 of the PMOS transistor M53. A base-emitter voltage of the bipolar transistor Q51 is equal to a base-emitter voltage of the bipolar transistor Q53. The base terminals of the bipolar transistors Q51 and Q52 are connected with each other, and have the same potential.

Accordingly, a potential difference ΔVbe applied to both end portions of the resistor 111 is given by, $$\Delta Vbe = Vbe51 - Vbe52$$

When the equations are combined, the following equation is obtained, $$\Delta Vbe = (kT/q) \times [\ln(Ie51/Is51) - \ln(Ie52/Is52)]$$
$$= (kT/q) \times \ln[(Is52/Is51) \times \ln(Ie51/Ie52)]$$

As described above, a ratio of the emitter areas of the bipolar transistors Q51 and Q52 is 1 to N. Further, the saturated current is proportional to an element area of a transistor. Accordingly, the following relationship is established, $$Is52 = Is51 \times N$$

As described above, the PMOS transistors M51 to M55 have the current-mirror relationship, so that the drain currents I51 to I55 thereof are identical. Accordingly, the emitter currents Ie51 and Ie52 of the bipolar transistors Q51 and Q52 are identical, and the following equation is established, $$\Delta Vbe = (kT/q) \times \ln(N)$$

Further, the drain current I52 of the PMOS transistor M52 is equal to a current flowing through the resistor 111. Accordingly, the following equation is established, $$I52 = \Delta Vbe/R51 = (1/R51) \times (kT/q) \times \ln(N)$$

Note that the transistors M51 to M55 have the current-mirror relationship, so that the drain currents I51 to I55 thereof are identical (I51=I52=I53=I54=I55).

In the embodiment, the collector terminal of the bipolar transistor Q52 is connected to the base terminal of the bipolar transistor Q53, and the collector terminal of the bipolar transistor Q52 has a potential the same as a base-emitter voltage Vbe53 of the bipolar transistor Q53. The collector terminal of the bipolar transistor Q53 is connected to the base terminal of the bipolar transistor Q54, and the collector terminal of the bipolar transistor Q53 has a potential the same as a base-emitter voltage Vbe54 of the bipolar transistor Q54. The collector terminal of the bipolar transistor Q54 is connected to the gate terminal of the PMOS transistor M54.

When the power source voltage VDD increases, the gate potentials of the PMOS transistors M51 to M55 increase to maintain the drain current I52 of the PMOS transistor M52. The collector potentials of the bipolar transistors Q51 to Q53 are maintained at levels of the base-emitter voltages Vbe51, Vbe53, and Vbe54, and do not fluctuate to a large extent. Accordingly, even when the bipolar transistors Q51 to Q53 have a low early voltage, the collector potentials thereof are maintained at the base-emitter voltages Vbe51, Vbe53, and Vbe54, thereby minimizing a variance in the collector current when the power source voltage VDD varies.

When the power source voltage VDD increases, or the drain current I51 of the PMOS transistor M51 increases slightly due to an influence of an external noise, the base-emitter voltage Vbe51 of the bipolar transistor Q51 increases slightly and the emitter current of the bipolar transistor Q52 increases. Accordingly, the voltage at both end portions of the resistor 111 increases, and the collector potential of the bipolar transistor Q52 increases. At this time, the collector potential of the bipolar transistor Q52 is equal to the base-emitter voltage Vbe53 of the bipolar transistor Q53. Accordingly, the collector potential of the bipolar transistor Q53 decreases slightly.

Further, the collector potential of the bipolar transistor Q53 is equal to the base-emitter voltage Vbe54 of the bipolar transistor Q54. Accordingly, the collector potential of the bipolar transistor Q54 increases slightly. Still further, the collector potential of the bipolar transistor Q23 is connected to the gate terminals of the PMOS transistors M51 to M55. Accordingly, when the collector potential of the bipolar transistor Q23 increases, the gate-source voltages of the PMOS transistors M51 to M55 decrease. As a result, there occurs a feedback of reducing the drain current I51 of the PMOS transistor M51, thereby canceling the slight increase in the drain current I51 of the PMOS transistor M51, i.e., a starting point of the feedback.

In the embodiment, the drain current I52 of the PMOS transistor M52 is equal to the drain current I55 of the PMOS transistor M55 (I52=I55). As described above, the drain current I52 of the PMOS transistor M52 is given by, $$I52 = \Delta Vbe/R21 = (1/R51) \times (kT/q) \times \ln(N)$$

At this time, the output voltage Vref is equal to a product of the drain current I55 and the resistivity R52 (Vref=I55×R52). Accordingly, the output voltage Vref of the PMOS transistor 43 is given by, $$Vref = (R52/R51) \times (kT/q) \times \ln(N)$$

According to the above equation, the output voltage Vref is proportional to the absolute temperature T, and the temperature coefficient at a room temperature becomes about +0.33%/V.

A potential Vref0 shown in FIG. 20 is given by, $$Vref0 = I51 \times R50 + Vbe51 = (R50/R51) \times (kT/q) \times \ln(N) + Vbe51$$

A first term of the above equation shows a positive temperature coefficient relative to the absolute temperature, and a second term of the above equation, i.e., a temperature coefficient of the base-emitter voltage of the bipolar transistor, becomes about −2.2%/V, i.e., a negative dependence. Accordingly, it is possible to set a temperature dependence of the potential Vref0 at about zero through properly setting a ratio of the resistivities R50 and R51.

Figure 21:
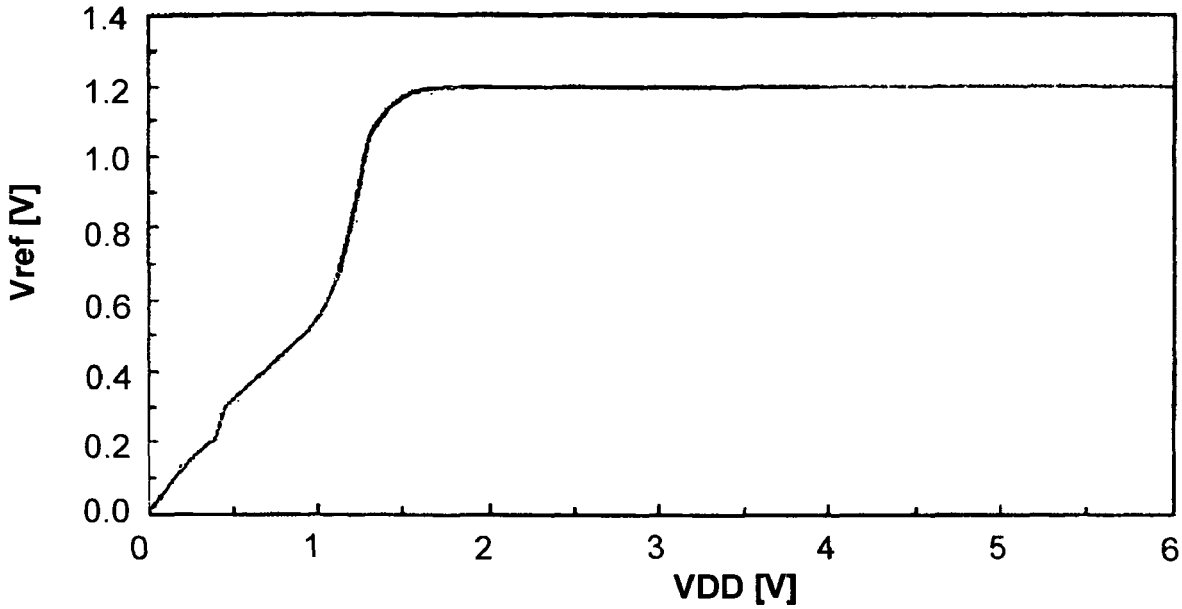
FIGS. 21(*a*) and 21(*b*) are graphs showing a property of the reference voltage generation circuit according to the fifth embodiment of the present invention, wherein FIG. 21(*a*) is a graph showing a relationship between the output voltage Vref and the power source voltage VDD, and FIG. 21(*b*) is a graph showing a relationship between a power source voltage dependence of the output voltage Vref and the power source voltage VDD.
Figure 21:
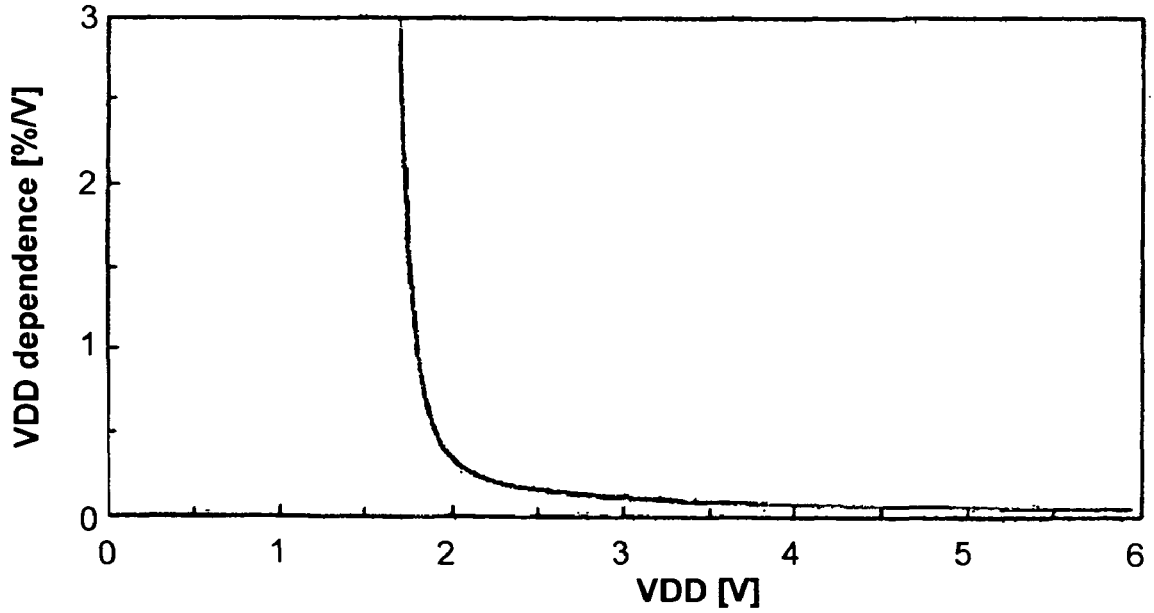
Figure 22:
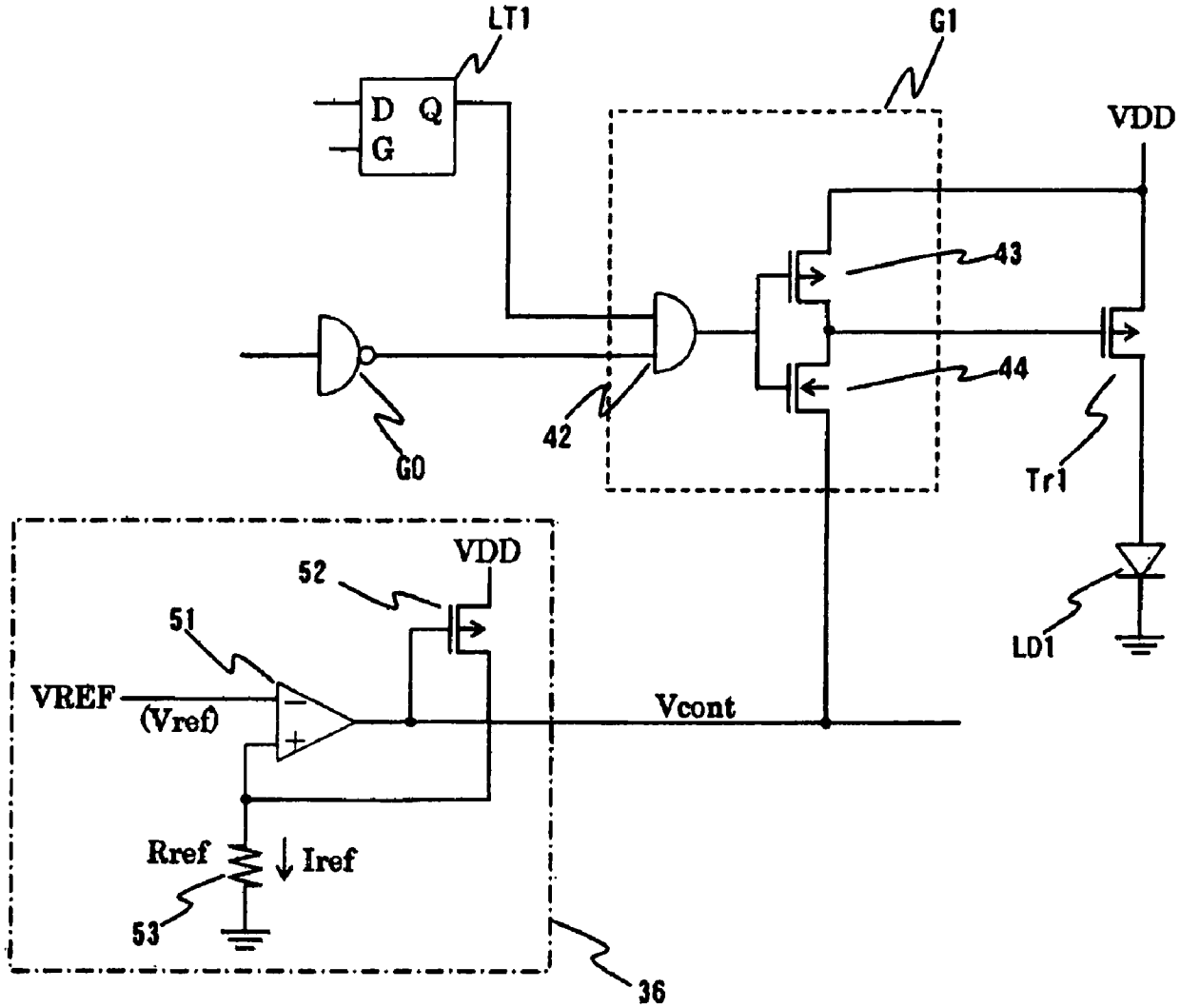
FIG. 22 is a circuit diagram showing a drive circuit of an LED head of a conventional printer.

FIGS. 21(*a*) and 21(*b*) are graphs showing a property of the reference voltage generation circuit according to the fifth embodiment of the present invention. FIG. 21(*a*) is a graph showing a relationship between the output voltage Vref and the power source voltage VDD. In FIG. 21(*a*), the horizontal axis represents the power source voltage VDD, and the vertical axis represents the output voltage Vref.

As shown in FIG. 21(*a*), the output voltage Vref is established when the power source voltage VDD becomes grater than 2 V (VDD>2 V). In the conventional circuit (hidden line), the output voltage Vref increases when the power source voltage VDD increases. In the reference voltage generation circuit 43 (solid line), the output voltage Vref is maintained constant when the power source voltage VDD increases.

FIG. 12(*b*) is a graph showing a relationship between a power source voltage dependence of the output voltage Vref and the power source voltage VDD. In FIG. 21(*b*), the power source voltage dependence of the output voltage Vref is defined by:

$$1/Vref \times (\Delta Vref/\Delta VDD) \times 100\ (\%/V)$$

As shown in FIG. 11(*b*), in the conventional circuit (hidden line), the output voltage Vref shows the power source voltage dependence of about 2.0%/° C. at the power source voltage VDD of 5 V. On the other hand, in the reference voltage generation circuit 40, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements.

As explained above, in the PMOS transistor 43, the output voltage Vref shows the power source voltage dependence of less than 0.1%/° C., and does not change when the power source voltage VDD varies. Accordingly, when the power source voltage VDD decreases upon driving the LED elements, the output voltage Vref does not change, thereby maintaining the drive current of the LED elements. As a result, it is possible to perform the printing operation at a constant print density.

The disclosure of Japanese Patent Application No. 2007-214832, filed on Aug. 21, 2007, is incorporated in the application by reference.

While the invention has been explained with reference to the specific embodiments of the invention, the explanation is illustrative and the invention is limited only by the appended claims.

What is claimed is:

1. A reference voltage generation circuit for generating a reference voltage, comprising:

a current-mirror circuit including a first MOS (Metal Oxide Semiconductor) transistor, a second MOS transistor including a gate terminal connected to a gate terminal of the first MOS transistor, and an output MOS transistor including a source terminal connected to a power source, a gate terminal connected to the gate terminal of the first MOS transistor, and a drain terminal for outputting the reference voltage; and a control circuit for controlling the current-mirror circuit so that an output current of the current-mirror circuit is converted to the reference voltage, said control circuit including a first transistor and a voltage decrease prevention circuit, said first transistor including a collector terminal connected to a drain terminal of the second MOS transistor, said voltage decrease prevention circuit being connected between the gate terminal of the output MOS transistor and the collector terminal of the first transistor, wherein said voltage decrease prevention circuit includes a second transistor including a base terminal connected to the collector terminal of the first transistor.

2. A drive circuit comprising the reference voltage generation circuit according to claim 1 and a drive circuit for driving a driven element according to the reference voltage.

3. A print head comprising a driven element and a drive circuit including the reference voltage generation circuit according to claim 1 for driving the driven element according to the reference voltage.

4. An image forming apparatus comprising a driven element and a drive circuit including the reference voltage generation circuit according to claim 1 for driving the driven element according to the reference voltage.

5. A reference voltage generation circuit for generating a reference voltage, comprising:

a current-mirror circuit including a plurality of MOS (Metal Oxide Semiconductor) transistors each including a source terminal connected to a power source and a gate terminal connected to with each other; and a plurality of transistors for controlling the current-mirror circuit so that an output current of the current-mirror circuit is converted to the reference voltage, each of said transistors including a collector terminal connected to a drain terminal of each of the MOS transistors so that a collector voltage of each of the transistors is maintained at a specific level and a collector current of each of the transistors is maintained constant when a voltage of the power source varies, wherein said current-mirror circuit includes first to fifth PMOS transistors each having a source terminal connected to the power source and a gate terminal connected to a drain terminal of the fourth PMOS transistor, said plurality of transistors including first to fourth bipolar transistors, said first bipolar transistor having a base terminal connected to a drain terminal of the first PMOS transistor, a collector terminal connected to the drain terminal of the first PMOS transistor through a first resistor, and an emitter terminal connected to ground, said second bipolar transistor having a base terminal connected to the collector terminal of the first bipolar transistor, a collector terminal connected to a drain terminal of the second PMOS transistor, and an emitter terminal connected to ground, said third bipolar transistor having a base terminal connected to the collector terminal of the second bipolar transistor, a collector terminal connected to a drain terminal of the third PMOS transistor, and an emitter terminal connected to ground, said fourth bipolar transistor having a base terminal connected to the collector terminal of the third bipolar transistor, a collector terminal connected to the drain terminal of the fourth PMOS transistor, and an emitter terminal connected to ground.

6. The reference voltage generation circuit according to claim 5, wherein said fifth PMOS transistor has a drain terminal connected to a second resistor connected to ground.

7. A drive circuit comprising the reference voltage generation circuit according to claim 5 and a drive circuit for driving a driven element according to the reference voltage.

8. A print head comprising a driven element and a drive circuit including the reference voltage generation circuit according to claim 5 for driving the driven element according to the reference voltage.

9. An image forming apparatus comprising a driven element and a drive circuit including the reference voltage generation circuit according to claim 5 for driving the driven element according to the reference voltage.

10. A reference voltage generation circuit for generating a reference voltage, comprising:

a current-mirror circuit including a plurality of MOS (Metal Oxide Semiconductor) transistors each including a source terminal connected to a power source and a gate terminal connected to with each other; and a plurality of transistors for controlling the current-mirror circuit so that an output current of the current-mirror circuit is converted to the reference voltage, each of said transistors including a. collector terminal connected to a drain terminal of each of the MOS transistors so that a collector voltage of each of the transistors is maintained at a specific level and a collector current of each of the transistors is maintained constant when a voltage of the power source varies, wherein said current-mirror circuit includes first to fifth PMOS transistors each having a source terminal connected to the power source and a gate terminal connected to a drain terminal of the fourth PMOS transistor, said fifth PMOS transistor having a drain terminal connected to a first resistor connected to ground, said plurality of transistors including first to third bipolar transistors and an NMOS transistor, said first bipolar transistor having a base terminal connected to a drain terminal of the first PMOS transistor, a collector terminal connected to the drain terminal of the first PMOS transistor through a second resistor, and an emitter terminal connected to ground, said second bipolar transistor having a base terminal connected to the collector terminal of the first bipolar transistor, a collector terminal connected to a drain terminal of the second PMOS transistor, and an emitter terminal connected to ground, said third bipolar transistor having a base terminal connected to the collector terminal of the second bipolar transistor, a collector terminal connected to a drain terminal of the third PMOS transistor, and an emitter terminal connected to ground, said NMOS transistor having a gate terminal connected to the collector terminal of the third bipolar transistor, a source terminal connected to ground, and a drain terminal connected to the drain terminal of the fourth PMOS transistor.

11. A drive circuit comprising the reference voltage generation circuit according to claim 10 and a drive circuit for driving a driven element according to the reference voltage.

12. A print head comprising a driven element and a drive circuit including the reference voltage generation circuit according to claim 10 for driving the driven element according to the reference voltage.

13. An image forming apparatus comprising a driven element and a drive circuit including the reference voltage generation circuit according to claim 10 for driving the driven element according to the reference voltage.

14. A reference voltage generation circuit for generating a reference voltage, comprising:

a current-mirror circuit including a plurality of MOS (Metal Oxide Semiconductor) transistors each including a source terminal connected to a power source and a gate terminal connected to with each other; and a plurality of transistors for controlling the current-mirror circuit so that an output current of the current-mirror circuit is converted to the reference voltage, each of said transistors including a collector terminal connected to a drain terminal of each of the MOS transistors so that a collector voltage of each of the transistors is maintained at a specific level and a collector current of each of the transistors is maintained constant when a voltage of the power source varies, wherein said current-mirror circuit includes first to fifth PMOS transistors each having a source terminal connected to the power source and a gate terminal connected to a drain terminal of the fourth PMOS transistor, said fifth PMOS transistor having a drain terminal connected to a first resistor connected to ground, said plurality of transistors including first and second bipolar transistors and first and second NMOS transistors, said first bipolar transistor having a base terminal connected to a drain terminal of the first PMOS transistor, a collector terminal connected to the drain terminal of the first PMOS transistor through a second resistor, and an emitter terminal connected to ground, said second bipolar transistor having a base terminal connected to the collector terminal of the first bipolar transistor, a collector terminal connected to a drain terminal of the second PMOS transistor, and an emitter terminal connected to ground, said first NMOS transistor having a gate terminal connected to the collector terminal of the second bipolar transistor, a source terminal connected to ground, and a drain terminal connected to a drain terminal of the third PMOS transistor, said second NMOS transistor having a gate terminal connected to the drain terminal of the first NMOS transistor, a source terminal connected to ground, and a drain terminal connected to the drain terminal of the fourth PMOS transistor.

15. A drive circuit comprising the reference voltage generation circuit according to claim 14 and a drive circuit for driving a driven element according to the reference voltage.

16. A print head comprising a driven element and a drive circuit including the reference voltage generation circuit according to claim 14 for driving the driven element according to the reference voltage.

17. An image forming apparatus comprising a driven element and a drive circuit including the reference voltage generation circuit according to claim 14 for driving the driven element according to the reference voltage.

18. A reference voltage generation circuit for generating a reference voltage, comprising:

a current-mirror circuit including a plurality of MOS (Metal Oxide Semiconductor) transistors each including a source terminal connected to a power source and a gate terminal connected to with each other; and a plurality of transistors for controlling the current-mirror circuit so that an output current of the current-mirror circuit is converted to the reference voltage, each of said transistors including a collector terminal connected to a drain terminal of each of the MOS transistors so that a collector voltage of each of the transistors is maintained at a specific level and a collector current of each of the transistors is maintained constant when a voltage of the power source varies, wherein said current-mirror circuit includes first to fifth PMOS transistors each having a source terminal connected to the power source and a gate terminal connected to a drain terminal of the fourth PMOS transistor, said fifth PMOS transistor having a drain terminal connected to a first resistor connected to ground, said plurality of transistors including first to fourth bipolar transistors, said first bipolar transistor having a base terminal and a collector terminal connected to a drain terminal of the first PMOS transistor, and an emitter terminal connected to ground, said second bipolar transistor having a bate terminal connected to the base terminal of the first bipolar transistor, a collector terminal connected to a drain terminal of the second PMOS transistor, and an emitter terminal connected to ground through a second resistor, said third bipolar transistor having a base terminal connected to the collector terminal of the second bipolar transistor, a collector terminal connected to a drain terminal of the third PMOS transistor, and an emitter terminal connected to ground, said fourth bipolar transistor having a base terminal connected to the collector terminal of the third bipolar transistor, a collector terminal connected to the drain terminal of the fourth PMOS transistor, and an emitter terminal connected to ground.

19. A drive circuit comprising the reference voltage generation circuit according to claim 18 and a drive circuit for driving a driven element according to the reference voltage.

20. A print head comprising a driven element and a drive circuit including the reference voltage generation circuit according to claim 18 for driving the driven element according to the reference voltage.

21. An image forming apparatus comprising a driven element and a drive circuit including the reference voltage generation circuit according to claim 18 for driving the driven element according to the reference voltage.

22. A reference voltage generation circuit for generating a reference voltage, comprising:

a current-mirror circuit including first and second MOS transistors each including a source terminal connected to a power source and a gate terminal connected to with each other;

first and second bipolar transistors each connected to a drain terminal of each of the first and second MOS transistors for controlling the current-mirror circuit, said first bipolar transistor having a collector terminal connected to a base terminal of the second bipolar transistor; and an operational amplifier for adjusting a collector potential of the first bipolar transistor at a level the same as that of a collector potential of the second bipolar transistor so that an output current of the current-mirror circuit is converted to the reference voltage.

23. A reference voltage generation circuit for generating a reference voltage, comprising:

a current-mirror circuit including a first MOS (Metal Oxide Semiconductor) transistor, a second MOS transistor including a gate terminal connected to a gate terminal of the first MOS transistor, and an output MOS transistor including a source terminal connected to a power source, a gate terminal connected to the ate terminal of the first MOS transistor, and a drain terminal for outputting the reference voltage; and a control circuit for controlling the current-mirror circuit so that an output current of the current-mirror circuit is converted to the reference voltage, said control circuit including a first transistor and a voltage decrease prevention circuit, said first transistor including a collector terminal connected to a drain terminal of the second MOS transistor, said voltage decrease prevention circuit being connected between the gate terminal of the output MOS transistor and the collector terminal of the first transistor, wherein said voltage decrease prevention circuit includes an NMOS transistor having a gate terminal connected to the collector terminal of the first transistor.

24. A reference voltage generation circuit for generating a reference voltage, comprising:

a current-mirror circuit including a first MOS (Metal Oxide Semiconductor) transistor, a second MOS transistor including a gate terminal connected to a gate terminal of the first MOS transistor, and an output MOS transistor including a source terminal connected to a power source, ate terminal connected to the gate terminal of the first MOS transistor, and a drain terminal for outputting the reference voltage; and a control circuit for controlling the current-mirror circuit so that an output current of the current-mirror circuit is converted to the reference voltage,sais control circuit including a first transistor and a voltage decrease prevention circuit, said first transistor including a collector terminal connected to a drain terminal of the second MOS transistor, said voltage decrease prevention circuit being connected between the gate terminal of the output MOS transistor and the collector terminal of the first transistor, wherein said voltage decrease prevention circuit includes an amplifier having an input terminal connected to the collector terminal of the first transistor and an output terminal connected to the gate terminal of the output MOS transistor.

* * * * *